US010012044B2

(12) United States Patent
Leba et al.

(10) Patent No.: US 10,012,044 B2
(45) Date of Patent: Jul. 3, 2018

(54) ANNULAR ISOLATION DEVICE FOR MANAGED PRESSURE DRILLING

(71) Applicant: Weatherford Technology Holding, LLC, Houston, TX (US)

(72) Inventors: John Vinh Leba, Cypress, TX (US); Mario M. Reyna, Pasadena, TX (US); Gordon Thomson, Houston, TX (US); Chau Nguyen, Katy, TX (US); Jerlib J. Leal, Houston, TX (US); Walter Scott Dillard, Houston, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 0 days.

(21) Appl. No.: 14/943,972

(22) Filed: Nov. 17, 2015

(65) Prior Publication Data

US 2016/0138352 A1 May 19, 2016

Related U.S. Application Data

(60) Provisional application No. 62/081,286, filed on Nov. 18, 2014.

(51) Int. Cl.

| | |
|---|---|
| ***E21B 21/08*** | (2006.01) |
| ***E21B 17/08*** | (2006.01) |
| ***E21B 33/06*** | (2006.01) |
| ***E21B 33/08*** | (2006.01) |

(52) U.S. Cl.

CPC ..... *E21B 21/08* (2013.01); *E21B 17/085* (2013.01); *E21B 33/06* (2013.01); *E21B 33/085* (2013.01)

(58) Field of Classification Search

None

See application file for complete search history.

(56) References Cited

U.S. PATENT DOCUMENTS

| | | | | |
|---|---|---|---|---|
| 3,667,721 | A | 6/1972 | Vujasinovic | |
| 4,108,318 | A * | 8/1978 | Rode | E21B 19/002 212/307 |
| 4,192,380 | A | 3/1980 | Smith | |
| 4,229,520 | A | 10/1980 | Bratt et al. | |

(Continued)

FOREIGN PATENT DOCUMENTS

| | | | |
|---|---|---|---|
| GB | 2 138 908 | A | 10/1984 |
| WO | 2013/006963 | A1 | 1/2013 |

(Continued)

OTHER PUBLICATIONS

PCT International Search Report and Written Opinion dated Mar. 3, 2016, for International Patent Application No. PCT/US2015/061134.

(Continued)

*Primary Examiner* — Matthew R Buck
*Assistant Examiner* — Douglas S Wood
(74) *Attorney, Agent, or Firm* — Patterson & Sheridan, L.L.P.

(57) ABSTRACT

An annular isolation device for managed pressure drilling includes a first housing portion coupled to a second housing portion; a packing element at least partially disposed in the first housing portion; a penetrator coupled to the first housing portion; and a carrier coupled to the second housing portion, wherein the carrier is configured to receive a portion of the penetrator.

22 Claims, 17 Drawing Sheets

(56) References Cited

U.S. PATENT DOCUMENTS

| | | | | |
|---|---|---|---|---|
| 4,496,173 | A | 1/1985 | Roche et al. | |
| 4,550,936 | A | 11/1985 | Haeber et al. | |
| 4,626,135 | A * | 12/1986 | Roche | E21B 21/001 166/84.4 |
| 5,992,893 | A | 11/1999 | Watkins | |
| 6,352,120 | B1 * | 3/2002 | Carbaugh | E21B 33/06 166/180 |
| 6,470,975 | B1 * | 10/2002 | Bourgoyne | E21B 21/001 166/367 |
| 7,337,854 | B2 | 3/2008 | Horn et al. | |
| 7,699,109 | B2 * | 4/2010 | May | E21B 33/085 166/339 |
| 8,413,724 | B2 * | 4/2013 | Carbaugh | E21B 17/085 166/344 |
| 9,074,425 | B2 | 7/2015 | Feasey | |
| 9,109,420 | B2 * | 8/2015 | Tindle | E21B 33/035 |
| 9,359,853 | B2 * | 6/2016 | Nas | E21B 33/085 |
| 2010/0319925 | A1 | 12/2010 | Papon et al. | |
| 2011/0017466 | A1 | 1/2011 | Averbuch et al. | |
| 2014/0123746 | A1 * | 5/2014 | Jaffrey | E21B 47/0001 73/152.18 |
| 2014/0178155 | A1 | 6/2014 | Feasey | |
| 2014/0196954 | A1 | 7/2014 | Mahmood et al. | |
| 2015/0096759 | A1 * | 4/2015 | Gilmore | E21B 43/01 166/345 |
| 2015/0204146 | A1 * | 7/2015 | Wagoner | E21B 7/12 166/358 |
| 2016/0076312 | A1 * | 3/2016 | Fraczek | E21B 19/002 166/367 |

FOREIGN PATENT DOCUMENTS

| | | | |
|---|---|---|---|
| WO | 2014/099965 | A2 | 6/2014 |
| WO | 2014/179538 | A1 | 11/2014 |

OTHER PUBLICATIONS

Extended European Search Report for Application No. 15151610.1-1610 dated Jun. 10, 2015; 8 total pages.

Australian Patent Examination Report for Application No. 2015200185 dated Oct. 13, 2015; 3 total pages.

Canadian Office Action for Application No. 2,878,557 dated Feb. 2, 2016; 6 total pages.

* cited by examiner

INSTALLED POSITION

UNDO BOLTS ON TOP OF AID

UNDO ELECTRO / HYDRAULIC LINES RUNNING ACROSS AID

LIFT UP UPPER SECTION TO SERVICE AID

ANNULAR ISOLATION DEVICE FOR MANAGED PRESSURE DRILLING

BACKGROUND OF THE DISCLOSURE

Field of the Disclosure

The present disclosure generally relates to an annular isolation device for managed pressure drilling.

Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Deep water offshore drilling operations are typically carried out by a mobile offshore drilling unit (MODU), such as a drill ship or a semi-submersible, having the drilling rig aboard and often make use of a marine riser extending between the wellhead of the well that is being drilled in a subsea formation and the MODU. The marine riser is a tubular string made up of a plurality of tubular sections that are connected in end-to-end relationship. The riser allows return of the drilling mud with drill cuttings from the hole that is being drilled. Also, the marine riser is adapted for being used as a guide for lowering equipment (such as a drill string carrying a drill bit) into the hole.

SUMMARY OF THE DISCLOSURE

In one embodiment, an annular isolation device for managed pressure drilling includes a first housing portion coupled to a second housing portion; a packing element at least partially disposed in the first housing portion; a penetrator coupled to the first housing portion; and a carrier coupled to the second housing portion, wherein the carrier is configured to receive a portion of the penetrator.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

Figure 1A:
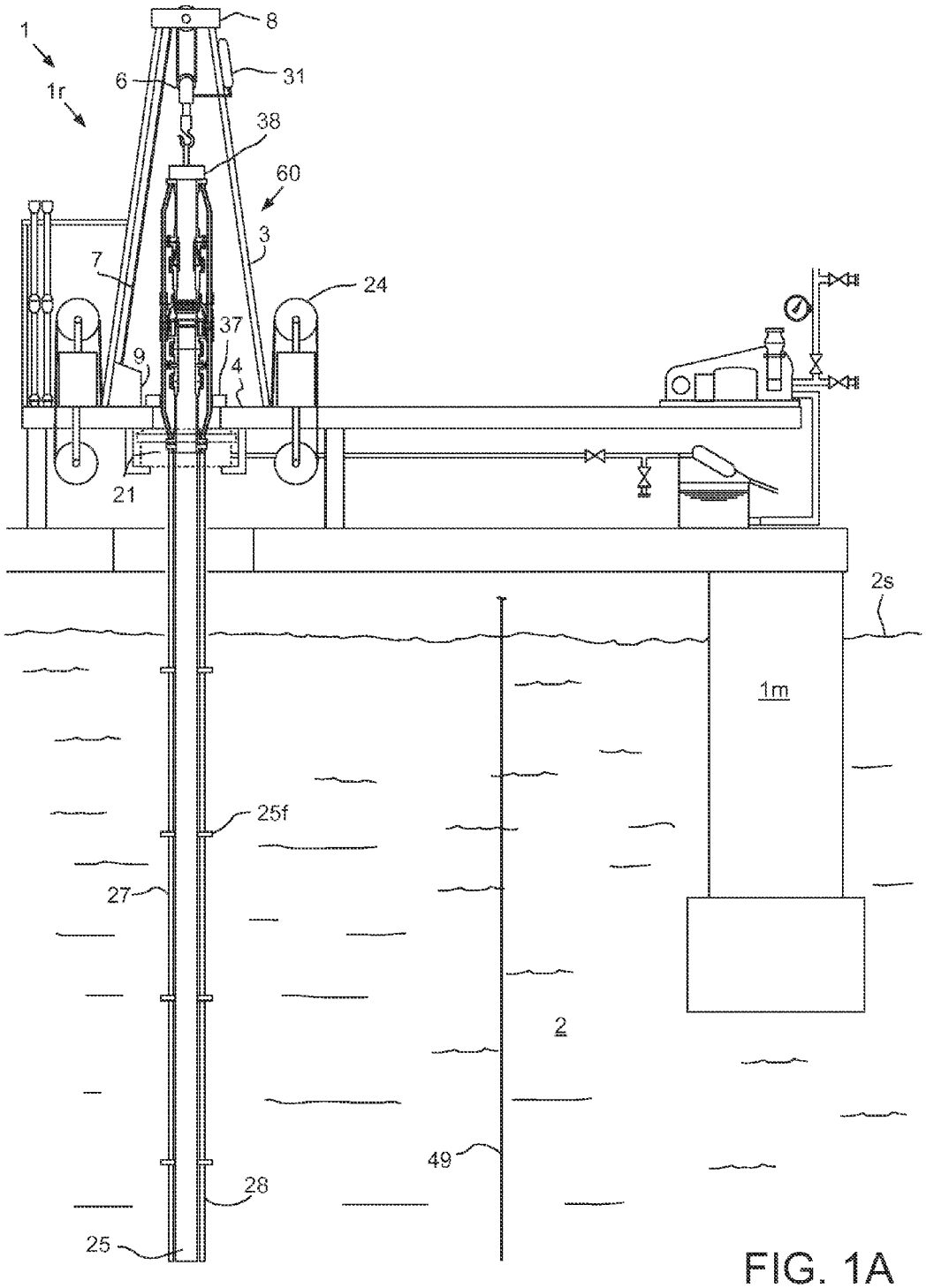
FIGS. 1A-1C illustrate an offshore drilling system in a riser deployment mode, according to one embodiment of the present disclosure.
Figure 1B:
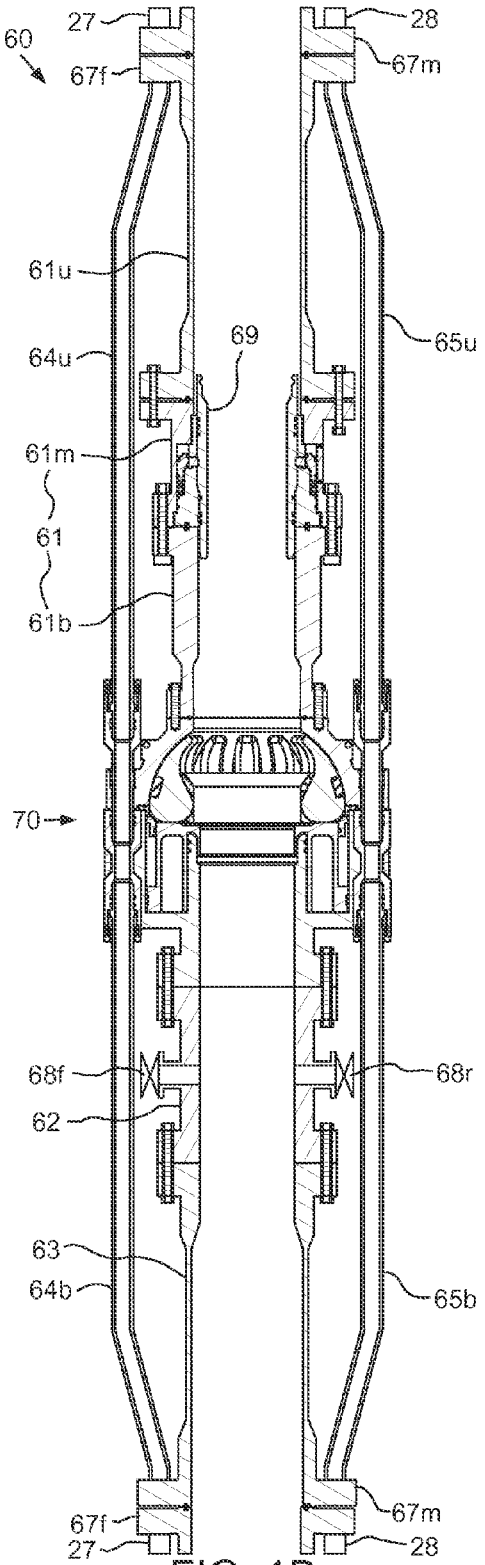
Figure 1C:
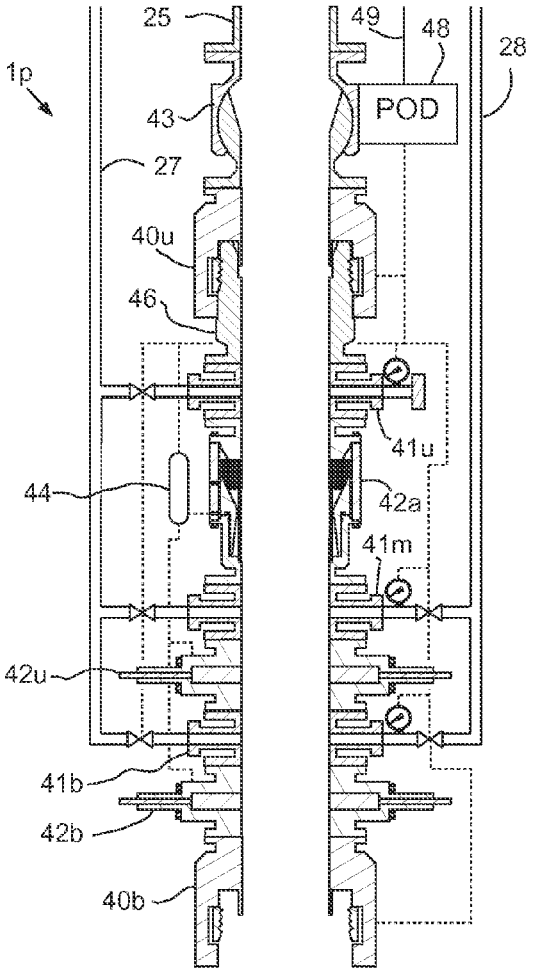
Figure 1C:
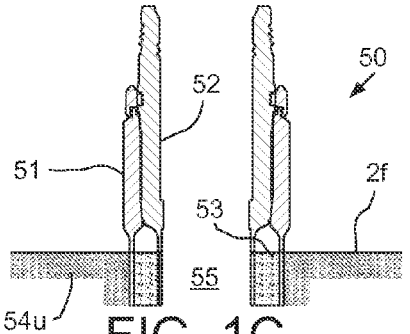

FIGS. 1A-1C illustrate an offshore drilling system 1 in a riser deployment mode, according to one embodiment of the present invention. The drilling system 1 may include a mobile offshore drilling unit (MODU) 1*m*, such as a semi-submersible, a drilling rig 1*r*, a fluid handling system 1*h* (only partially shown, see FIG. 5A), a fluid transport system 1*t* (only partially shown, see FIGS. 5A-5C), and a pressure control assembly (PCA) 1*p*. The MODU 1*m* may carry the drilling rig 1*r* and the fluid handling system 1*h* aboard and may include a moon pool, through which operations are conducted. The semi-submersible MODU 1*m* may include a lower barge hull which floats below a surface (aka waterline) 2*s* of sea 2 and is, therefore, less subject to surface wave action. Stability columns (only one shown) may be mounted on the lower barge hull for supporting an upper hull above the waterline. The upper hull may have one or more decks for carrying the drilling rig 1*r* and fluid handling system 1*h*. The MODU 1*m* may further have a dynamic positioning system (DPS) (not shown) or be moored for maintaining the moon pool in position over a subsea wellhead 50.

Alternatively, the MODU 1*m* may be a drill ship. Alternatively, a fixed offshore drilling unit or a non-mobile floating offshore drilling unit may be used instead of the MODU 1*m*.

The drilling rig 1*r* may include a derrick 3 having a rig floor 4 at its lower end having an opening corresponding to the moonpool. The rig 1*r* may further include a traveling block 6 be supported by wire rope 7. An upper end of the wire rope 7 may be coupled to a crown block 8. The wire rope 7 may be woven through sheaves of the blocks 6, 8 and extend to drawworks 9 for reeling thereof, thereby raising or lowering the traveling block 6 relative to the derrick 3. A running tool 38 may be connected to the traveling block 6, such as by a heave compensator 31.

Alternatively, the heave compensator 31 may be disposed between the crown block 8 and the derrick 3.

Figure 5A:
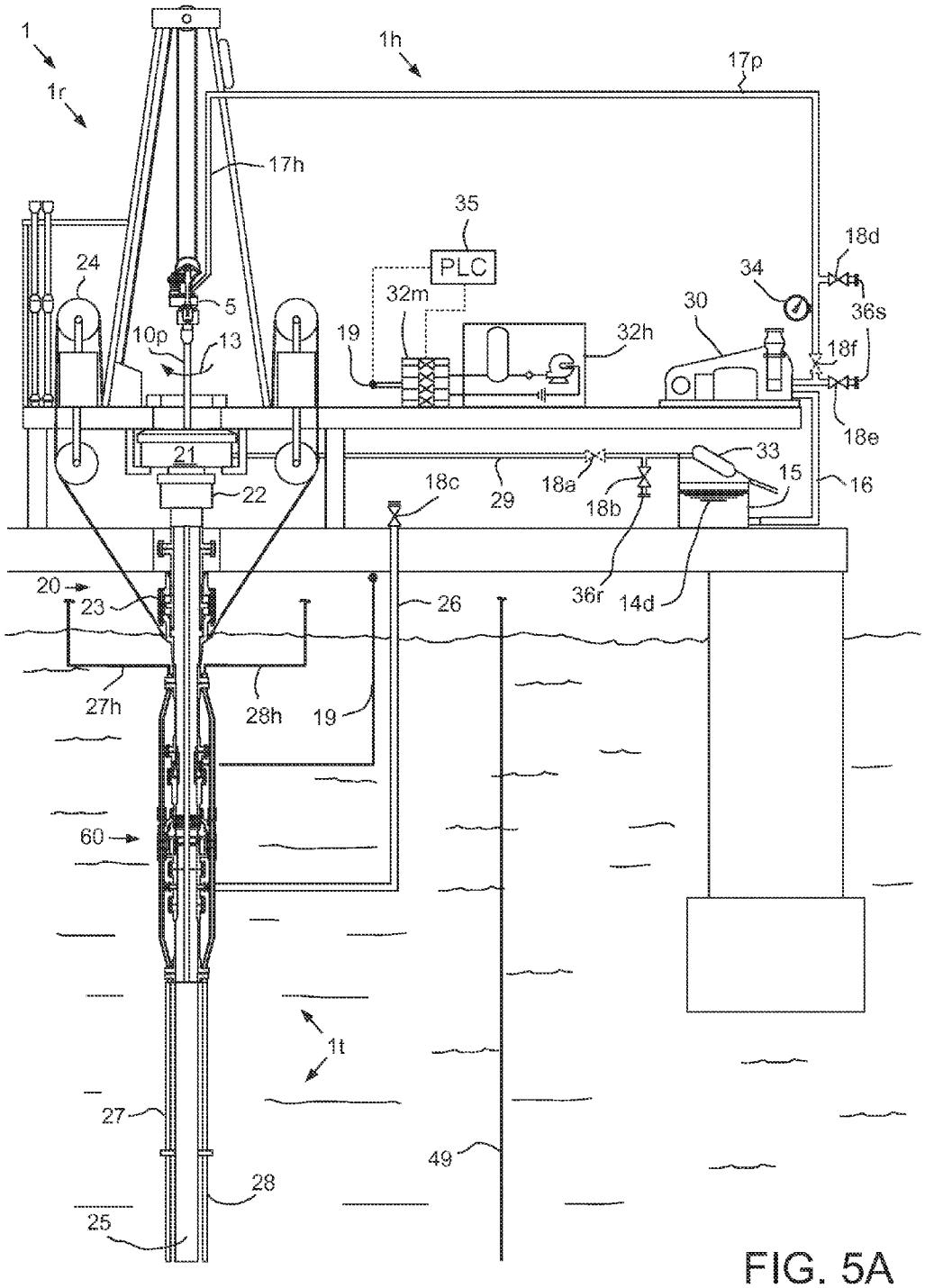
FIGS. 5A-5C illustrate the offshore drilling system in an overbalanced drilling mode.
Figure 5B:
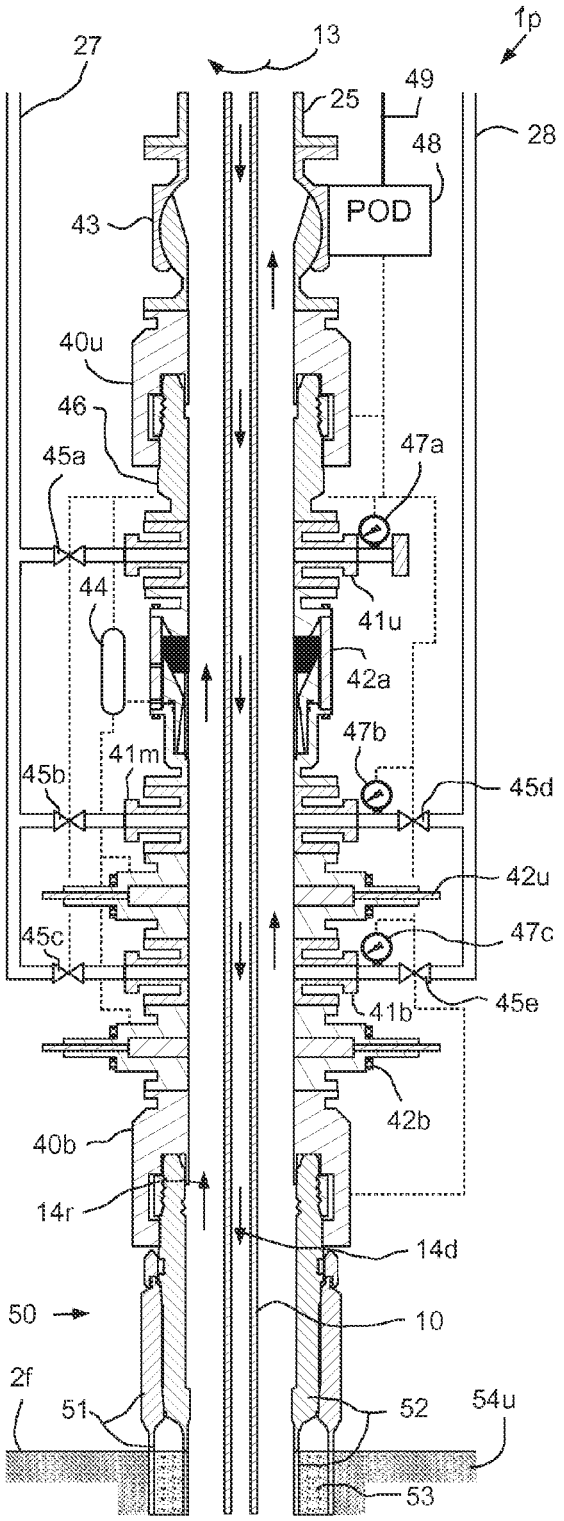
Figure 5C:
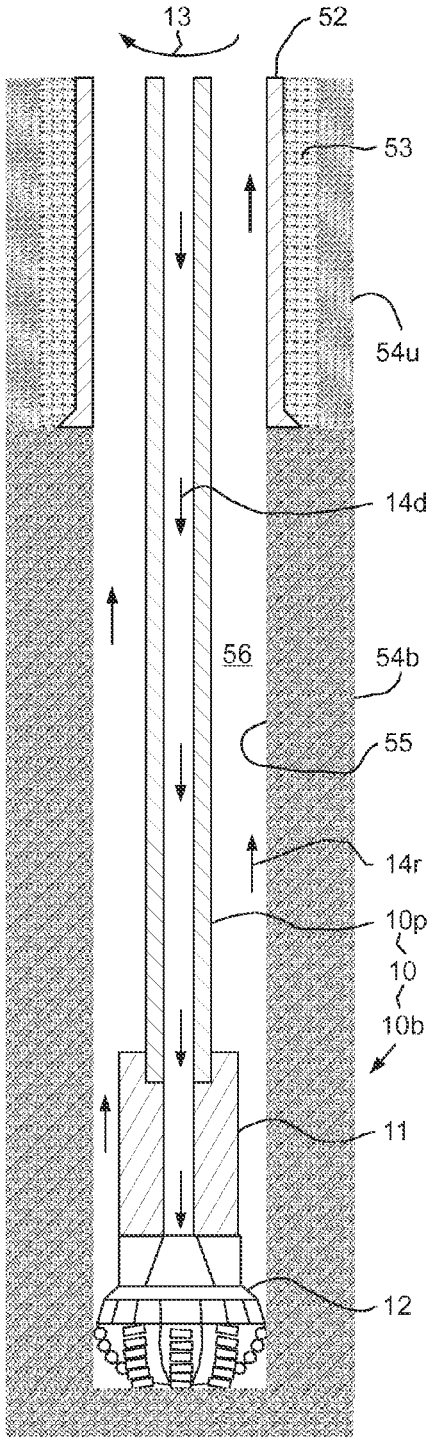

A fluid transport system 1*t* may include an upper marine riser package (UMRP) 20 (only partially shown, see FIG. 5A), a managed pressure marine riser package (MPRP) 60, a marine riser 25, one or more auxiliary lines 27, 28, such as a kill line 27 and a choke line 28 (collectively C/K lines), and a drill string 10 (FIGS. 5A-5C). Additionally, the auxiliary lines 27, 28 may further include a booster line (not shown) and/or one or more hydraulic lines for charging the accumulators 44. During deployment, the PCA 1*p* may be connected to a wellhead 50 located adjacent to a floor 2*f* of the sea 2.

A conductor string 51 may be driven into the seafloor 2*f*. The conductor string 51 may include a housing and joints of conductor pipe connected together, such as by threaded connections. Once the conductor string 51 has been set, a subsea wellbore 55 may be drilled into the seafloor 2*f* and a casing string 52 may be deployed into the wellbore. The casing string 52 may include a wellhead housing and joints of casing connected together, such as by threaded connections. The wellhead housing may land in the conductor housing during deployment of the casing string 52. The casing string 52 may be cemented 53 into the wellbore 55. The casing string 52 may extend to a depth adjacent a bottom of an upper formation 54*u* (FIG. 5C). The upper formation 54*u* may be non-productive and a lower formation 54*b* (FIG. 5C) may be a hydrocarbon-bearing reservoir. Although shown as vertical, the wellbore 55 may include a vertical portion and a deviated, such as horizontal, portion.

Alternatively, the lower formation 54*b* may be environmentally sensitive, such as an aquifer, or unstable.

The PCA 1*p* may include a wellhead adapter 40*b*, one or more flow crosses 41*u,m,b*, one or more blow out preventers (BOPs) 42*a,u,b*, a lower marine riser package (LMRP), one or more accumulators 44, and a receiver 46. The LMRP may include a control pod 48, a flex joint 43, and a connector 40*u*. The wellhead adapter 40*b*, flow crosses 41*u,m,b*, BOPs 42*a,u,b*, receiver 46, connector 40*u*, and flex joint 43, may each include a housing having a longitudinal bore therethrough and may each be connected, such as by flanges, such that a continuous bore is maintained therethrough. The bore may have drift diameter, corresponding to a drift diameter of the wellhead 50.

Each of the connector 40*u* and wellhead adapter 40*b* may include one or more fasteners, such as dogs, for fastening the LMRP to the BOPs 42*a,u,b* and the PCA 1*p* to an external profile of the wellhead housing, respectively. Each of the connector 40*u* and wellhead adapter 40*b* may further include a seal sleeve for engaging an internal profile of the respective receiver 46 and wellhead housing. Each of the connector 40*u* and wellhead adapter 40*b* may be in electric or hydraulic communication with the control pod 48 and/or further include an electric or hydraulic actuator and an interface, such as a hot stab, so that a remotely operated subsea vehicle (ROV) (not shown) may operate the actuator for engaging the dogs with the external profile.

The LMRP may receive a lower end of the riser 25 and connect the riser to the PCA 1*p*. The control pod 48 may be in electric, hydraulic, and/or optical communication with a rig controller (not shown) onboard the MODU 1*m* via an umbilical 49. The control pod 48 may include one or more control valves (not shown) in communication with the BOPs 42*a,u,b* for operation thereof. Each control valve may include an electric or hydraulic actuator in communication with the umbilical 49. The umbilical 49 may include one or more hydraulic or electric control conduit/cables for the actuators. The accumulators 44 may store pressurized hydraulic fluid for operating the BOPs 42*a,u,b*. Additionally, the accumulators 44 may be used for operating one or more of the other components of the PCA 1*p*. The umbilical 49 may further include hydraulic, electric, and/or optic control conduit/cables for operating various functions of the PCA 1*p*. The rig controller may operate the PCA 1*p* via the umbilical 49 and the control pod 48.

A lower end of the kill line 27 may be connected to a branch of the flow cross 41*u* by a shutoff valve 45*a* (FIG. 5B). A kill manifold may also connect to the kill line lower end and have a prong connected to a respective branch of each flow cross 41*m,b*. Shutoff valves 45*b,c* (FIG. 5B) may be disposed in respective prongs of the kill manifold. An upper end of the kill line 27 may be connected to an outlet of a kill fluid tank (not shown) and an upper end of the choke line 28 may be connected to a rig choke (not shown). A lower end of the choke line 28 may have prongs connected to respective second branches of the flow crosses 41*m,b*. Shutoff valves 45*d,e* (FIG. 5B) may be disposed in respective prongs of the choke line lower end.

A pressure sensor 47*a* (FIG. 5B) may be connected to a second branch of the upper flow cross 41*u*. Pressure sensors 47*b,c* (FIG. 5B) may be connected to the choke line prongs between respective shutoff valves 45*d,e* and respective flow cross second branches. Each pressure sensor 47*a-c* may be in data communication with the control pod 48. The lines 27, 28 and may extend between the MODU 1*m* and the PCA 1*p* by being fastened to flanged connections 25*f* between joints of the riser 25. The umbilical 49 may also extend between the MODU 1*m* and the PCA 1*p*. Each shutoff valve 45*a-e* may be automated and have a hydraulic actuator (not shown) operable by the control pod 48 via fluid communication with a respective umbilical conduit or the LMRP accumulators 44. Alternatively, the valve actuators may be electrical or pneumatic.

Once deployed, the riser 25 may extend from the PCA 1*p* to the MPRP 60 and the MPRP 60 may connect to the MODU 1*m* via the UMRP 20. The UMRP 20 may include a diverter 21, a flex joint 22, a slip (aka telescopic) joint 23 upon deployment, and a tensioner 24. The slip joint 23 may include an outer barrel and an inner barrel connected to the flex joint 22, such as by a flanged connection. The outer barrel may be connected to the tensioner 24, such as by a tensioner ring, and may further include a termination ring for connecting upper ends of the lines 27, 28 to respective hoses 27*h*, 28*h* (FIG. 5A) leading to the MODU 1*m*.

The flex joint 22 may also connect to a mandrel of the diverter 21, such as by a flanged connection. The diverter mandrel may be hung from the diverter housing during deployment of the riser 25. The diverter housing may also be connected to the rig floor 4, such as by a bracket. The slip joint 23 may be operable to extend and retract in response to heave of the MODU 1*m* relative to the riser 25 while the tensioner 24 may reel wire rope in response to the heave, thereby supporting the riser 25 from the MODU 1*m* while accommodating the heave. The flex joints 23, 43 may accommodate respective horizontal and/or rotational (aka pitch and roll) movement of the MODU 1*m* relative to the riser 25 and the riser relative to the PCA 1*p*. The riser 25 may have one or more buoyancy modules (not shown) disposed therealong to reduce load on the tensioner 24.

In operation, a lower portion of the riser 25 may be assembled using the running tool 38 and a riser spider (not shown). The riser 25 may be lowered through a rotary table 37 located on the rig floor 4. A lower end of the riser 25 may then be connected to the PCA 1*p* in the moonpool. The PCA 1*p* may be lowered through the moonpool by assembling joints of the riser 25 using the flanges 25*f*. Once the PCA 1*p* nears the wellhead 50, the MPRP 60 may be connected to an upper end of the riser 25 using the running tool 38 and spider. The MPRP 60 may then be lowered through the rotary table 37 and into the moonpool by connecting a lower end of the outer barrel of the slip joint 23 to an upper end of the MPRP and assembling the other UMRP components (slip joint locked). The diverter mandrel may be landed into the diverter housing and the tensioner 24 connected to the tensioner ring. The tensioner 24 and slip joint 23 may then be operated to land the PCA 1*p* onto the wellhead 50 and the PCA latched to the wellhead.

In order to pass through the rotary table 37 on some existing rigs 1*r*, the MPRP 60 may have a maximum outer diameter less than or equal to a drift diameter of the rotary table, such as less than or equal to sixty inches or less than or equal to fifty-seven and one-quarter inches.

The pod 48 and umbilical 49 may be deployed with the PCA 1*p* as shown. Alternatively, the pod 48 may be deployed in a separate step after the riser deployment operation. In this alternative, the pod 48 may be lowered to the PCA 1*p* using the umbilical 49 and then latched to a receptacle (not shown) of the LMRP. Alternatively, the umbilical 49 may be secured to the riser 25.

Referring specifically to FIG. 1B, the MPRP 60 may include a rotating control device (RCD) housing 61, an annular isolation device (AID) 70, a flow spool 62, and a lower adapter spool 63. The RCD housing 60 may be tubular and have one or more sections 61*u,m,b* connected together, such as by flanged connections. The housing sections may include an upper adapter spool 61*u*, a latch spool 61*m*, a lower spool 61*b*. The MPRP 60 may further include one or more auxiliary jumpers 64*u,b*, 65*u,b* for routing the respective kill line 27 and the choke line 28 around and/or through the MPRP components 61-63, 70.

The lower adapter spool 63 may be tubular and include an upper flange, a lower adapter flange 67*m*, and a body connecting the flanges, such as by being welded thereto. The upper flange may mate with a lower flange of the flow spool 62, thereby connecting the two components. The lower adapter flange 67*m* may mate with an upper flange 67*f* of the riser 25, thereby connecting the two components. The upper RCD housing spool 61*u* may be tubular and include an upper adapter flange 67*f*, a lower flange, and a body connecting the flanges, such as by being welded thereto. The upper adapter flange 67*f* may mate with a lower adapter flange 67*m* of the slip joint 23, thereby connecting the two components. The lower flange may mate with an upper flange of the RCD housing latch spool 61*m*, thereby connecting the two components. The RCD housing latch spool 61*m* may be tubular and include an upper flange, a lower flange, and a body connecting the flanges, such as by being welded thereto. The lower flange may mate with an upper flange of the RCD housing lower spool 61*b*, thereby connecting the two components. The RCD housing lower spool 61*b* may be tubular and include an upper flange, a lower flange, and a body connecting the flanges, such as by being welded thereto. The lower flange may mate with an upper flange of the AID 70, thereby connecting the two components.

The flow spool 62 may be tubular and include an upper flange, a lower flange, and a body connecting the flanges, such as by being welded thereto. The flow spool body may include one or more (pair shown) branch ports formed through a wall thereof and having port flanges. A shutoff valve 68*f,r* may be connected to the respective port flange. The upper flange may mate with a lower flange of the AID 70, thereby connecting the two components.

Each jumper 64*u,b*, 65*u,b* may be pipe made from a metal or alloy, such as steel, stainless steel, nickel based alloy. Alternatively, each jumper 64*u,b*, 65*u,b* may be a hose made from a flexible polymer material, such as a thermoplastic or elastomer, or may be a metal or alloy bellows. Each hose may or may not be reinforced, such as by metal or alloy cords.

Although shown schematically, each adapter flange 67*m,f* may have a bore formed therethrough, a respective neck portion, a respective rim portion, and a coupling for each of the auxiliary lines 27, 28 or jumpers 64*u,b*, 65*u,b*. Each rim portion may have sockets and holes (not shown) formed therethrough and spaced therearound in an alternating fashion. The holes may receive fasteners, such as bolts or studs and nuts. Each rim portion may further have a seal bore formed in an inner surface thereof and a shoulder formed at the end of the seal bore. A seal sleeve may carry one or more seals for each flange 67*m,f* along an outer surface thereof and be fastened to each male flange 67*m* with the seal therefore in engagement with the seal bore thereof. The seal bore of each female flange 67*f* may receive the respective seal sleeve and the sleeve may be trapped between the seal bore shoulders.

Each flange socket may receive the respective coupling. Each coupling may have an end for connection to the respective auxiliary lines 27, 28 or jumpers 64*u,b*, 65*u,b*, such as by welding. Each female coupling may be retained in the respective flange socket by mating shoulders. Each male coupling may have a nut fastened thereto, such as by threads. The nut may have a shoulder formed in an outer surface thereof for retaining the male coupling in the respective flange socket. Each female coupling may have a seal bore formed in an inner surface thereof for receiving a complementary stinger of the respective male coupling. The seal bore may carry one or more seals for sealing an interface between the respective stinger and the seal bore. The stabbing depth of the male coupling into the female coupling may be adjusted using the nut.

Alternatively, each male coupling may carry the seals instead of the respective female coupling. Alternatively, the male-down convention illustrated in FIG. 1B may be reversed.

Figure 2A:
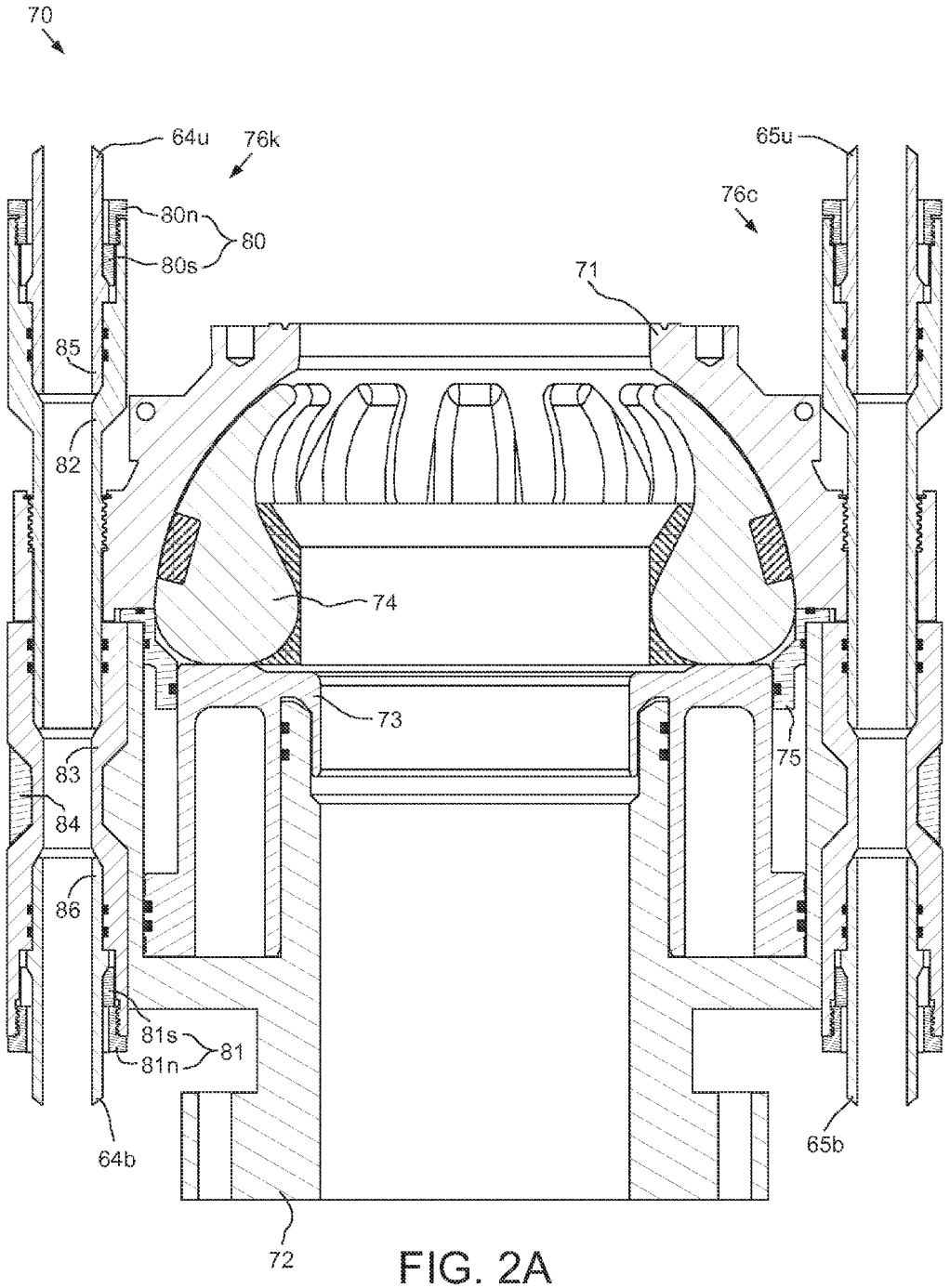
FIGS. 2A-2E illustrate an annular isolation device (AID) of the drilling system.
Figure 2B:
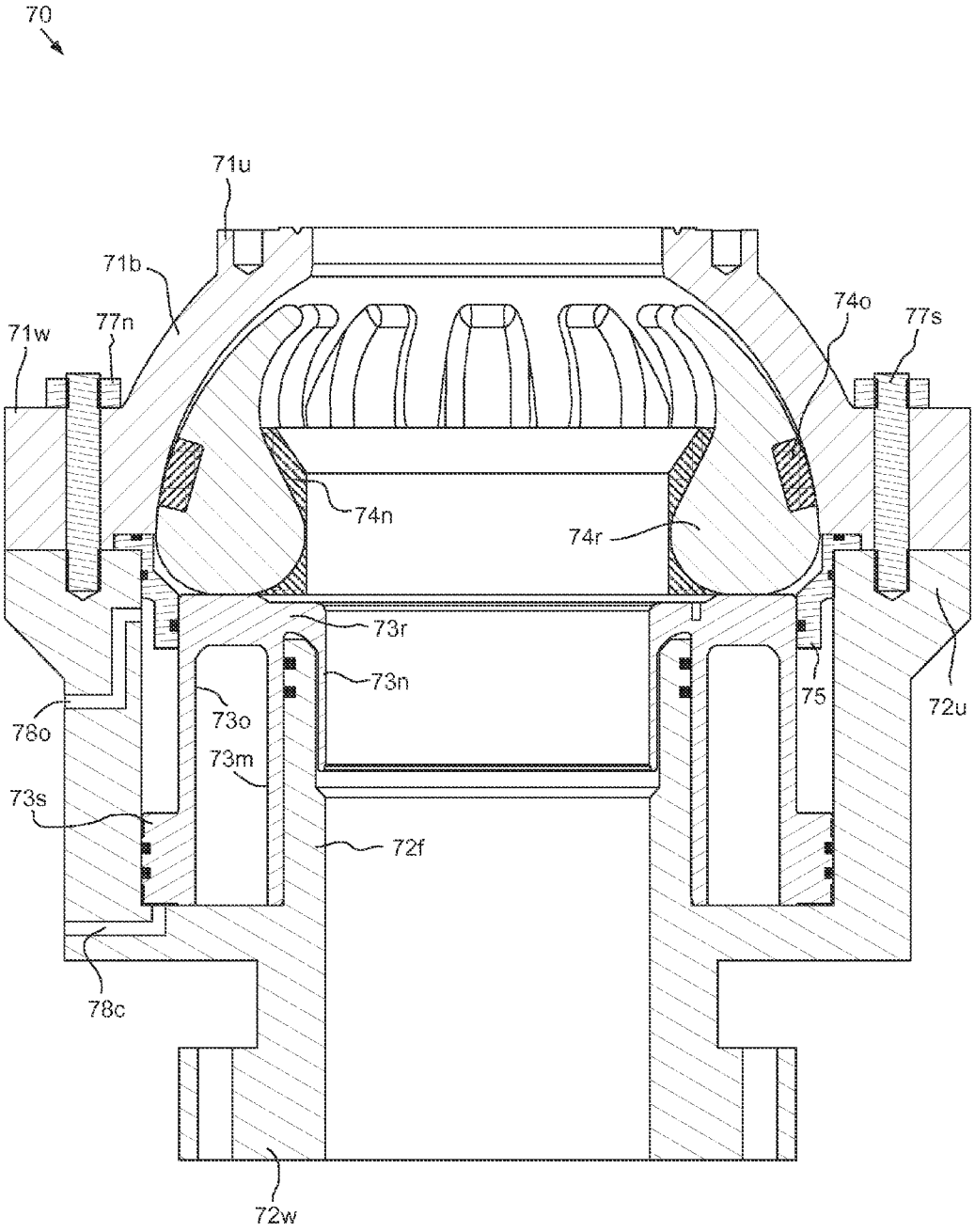
Figure 2C:
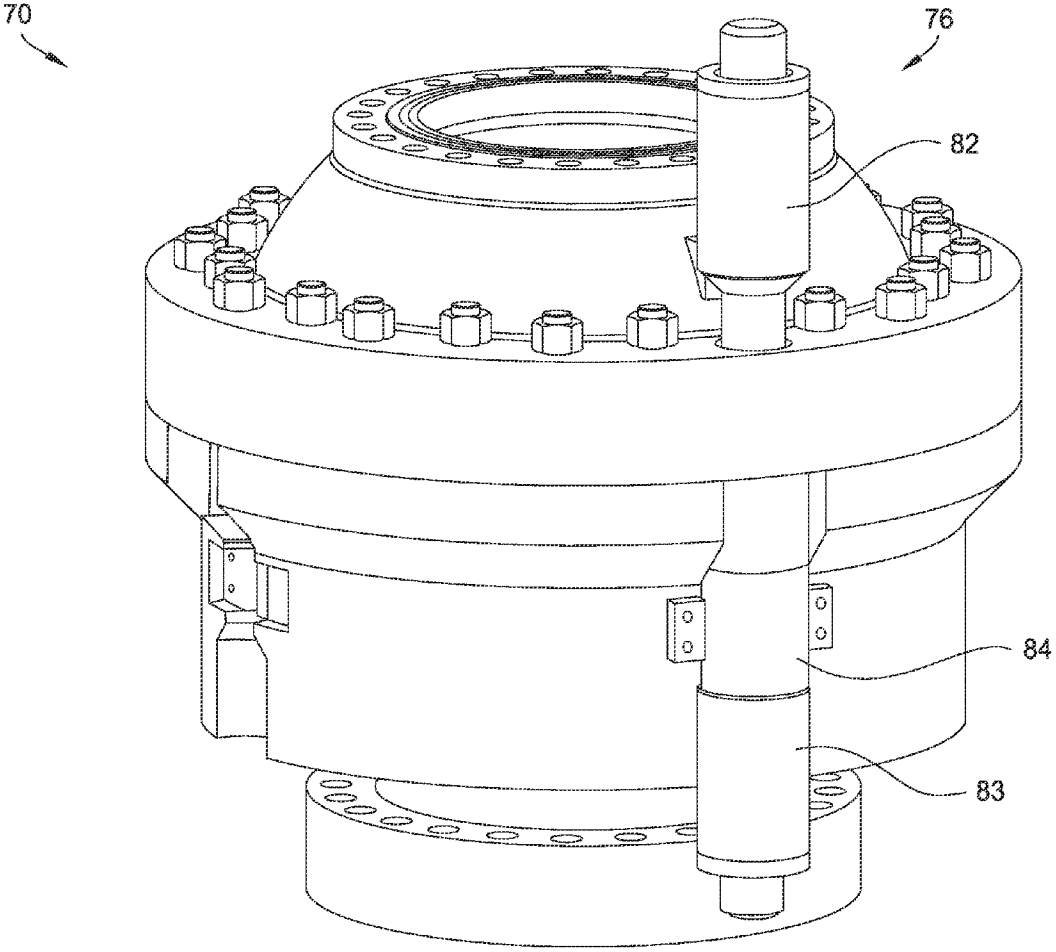
Figure 2D:
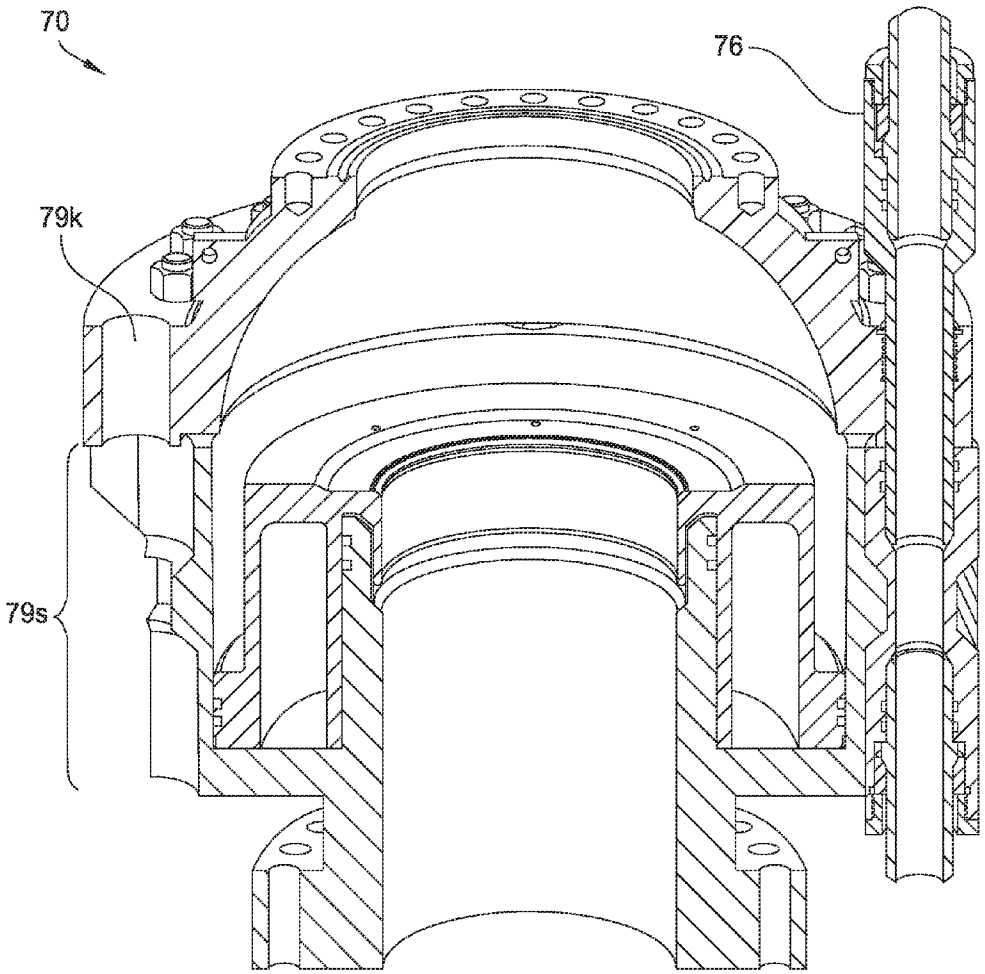
Figure 2E:
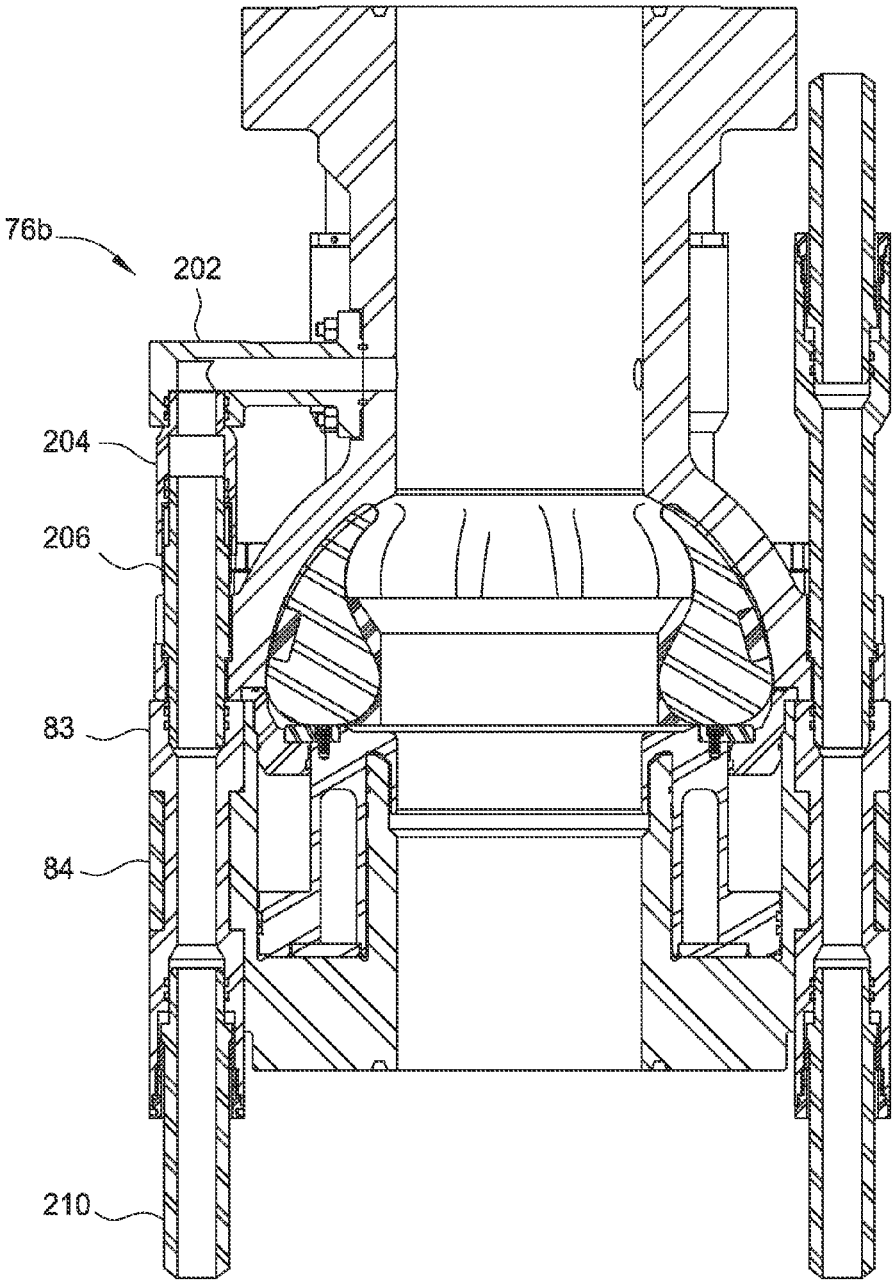
Figure 3A:
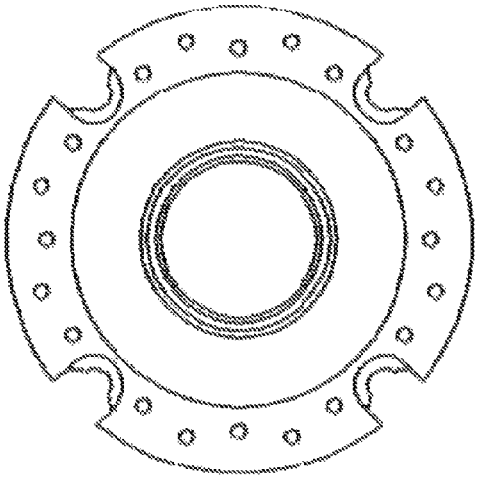
FIGS. 3A-3C illustrate a lower housing of the AID.
Figure 3B:
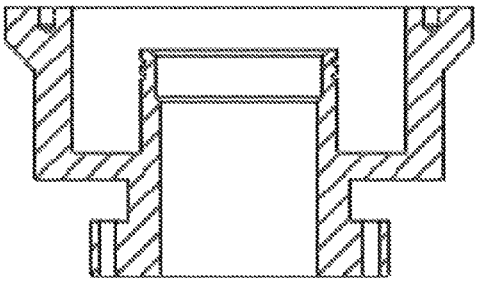
Figure 3C:
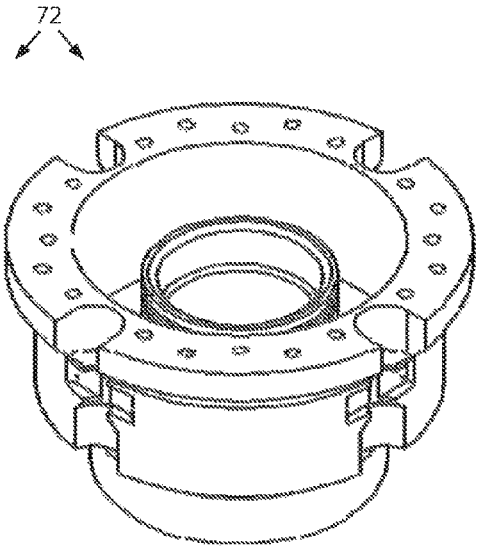
Figure 4B:
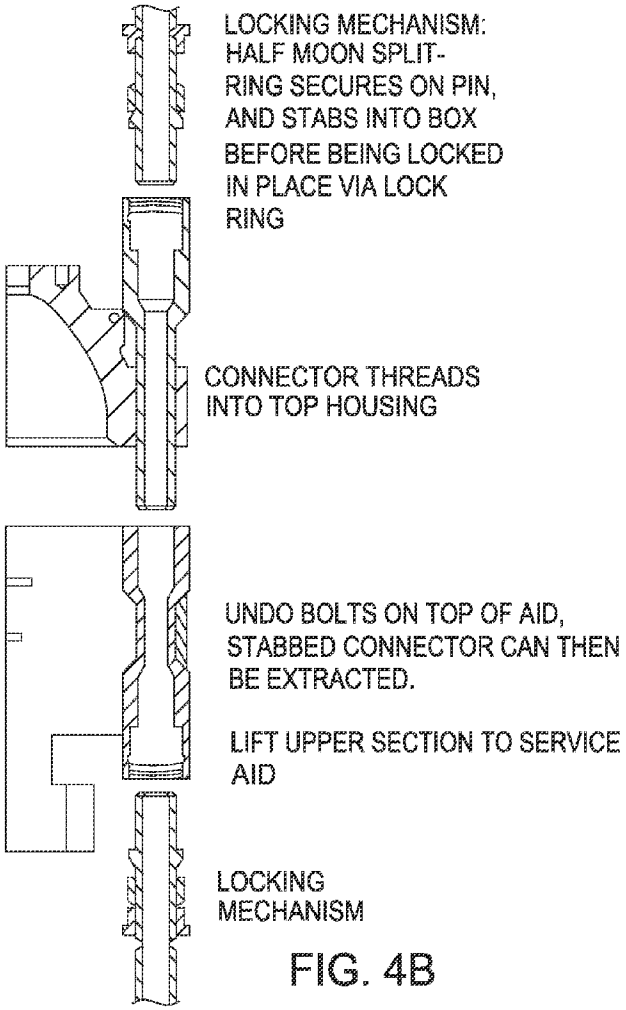
FIGS. 4A and 4B illustrate a riser auxiliary line junction of the AID.
Figure 4A:
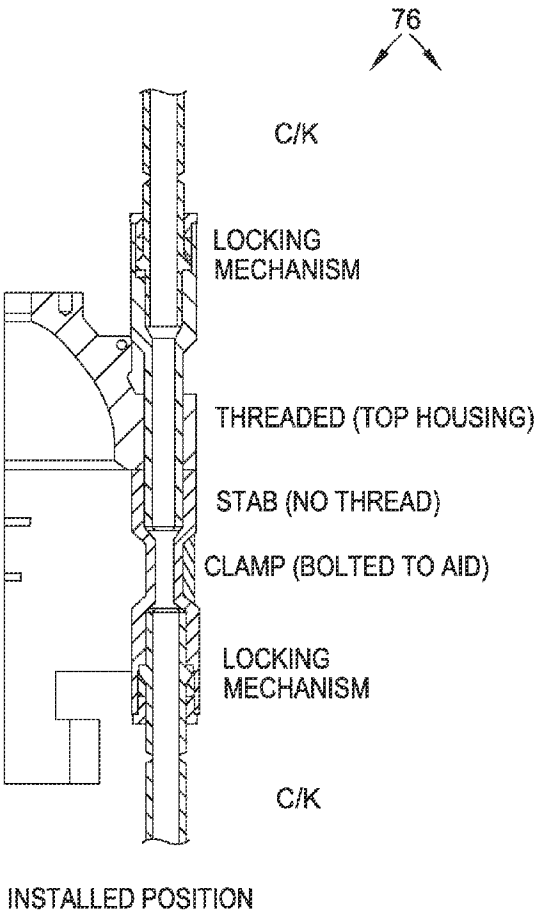

FIGS. 2A-2E illustrate the AID 70. FIGS. 3A-3C illustrate a lower housing 72 of the AID 70. FIGS. 4A and 4B illustrate a riser auxiliary line junction 76 of the AID 70. The AID 70 may be an annular BOP, such as a spherical BOP, and may include an upper housing 71, the lower housing 72, a piston 73, a packing element 74, an adapter ring 75, and one or more, such as four, riser auxiliary line junctions 76*c,k*.

The upper housing 71 may have an upper flange 71*u*, a lower flange 71*w*, and a bowl 71*b* connecting the flanges. The bowl 71*b* and flanges 71*u,w* may be integrally formed or welded together. In one embodiment, the lower spool 61*b* is coupled, such as bolted, to the upper flange 71*u*. Alternatively the lower spool 61*b* and the upper housing 71 are integrally formed. The lower housing 72 may have an upper flange 72*u*, a lower flange 72*w*, and a fork 72*f* connecting the flanges. The lower flange 71*w* of the upper housing 71 and the upper flange 72*u* of the lower housing 72 may be connected by a plurality of threaded fasteners, such as studs 77*s* and nuts 77*n*. Disconnection of the upper housing 71 from the lower housing 72 may facilitate replacement of the packing element 74.

The packing element 74 may include an inner seal ring 74*n*, an outer seal ring 74*o*, and a plurality of ribs 74*r* spaced around the packing element. The seal rings 74*n,o* may be each be made from an elastomer or elastomeric copolymer and the ribs 74*r* may each be made from a metal, alloy, or engineering polymer. The bowl 71*b* may have a spherical inner surface and the ribs 74*r* may have a curved outer surface conforming to the spherical inner surface. The packing element 74 may be movable between an open position (shown) and a closed position (FIG. 6A) by interaction with the piston 73. The outer seal 74*o* may seal an interface between the packing element 74 and the bowl 74*b* and the inner seal 74*n* may engage an outer surface of the drill string 10 in the closed position, thereby sealing an annulus formed between the riser string 25 and the drill string. In the open position, the packing element 74 may be clear of a bore formed through the AID 70.

The adapter ring 75 may be disposed in an interface formed among the upper housing 71, the lower housing 72, and the piston 73 and carry seals for sealing the interface. One of the housings 71, 72, such as the upper housing 71, may have a groove formed in an inner surface thereof and an outer lip of the of the adapter ring 75 may extend into the groove, thereby trapping the adapter ring between the lower flange 71*w* and the upper flange 72*u*.

The piston 73 may have an outer wall 73*o*, an inner wall 73*n*, a mid wall 73*m*, a ring 73*r* connecting the walls, and an outer shoulder 73*s* formed at a lower end of the outer wall. The piston 73 may be disposed in a hydraulic chamber formed between inner and outer walls of the fork 72*f* and the shoulder 73*s* may carry one or more (pair shown) seals engaged with an inner surface of the outer wall of the fork. The inner wall of the fork 72*f* may carry one or more seals for engagement with an inner surface of the mid wall 73*m* of the piston 73. A bottom of the packing element 74 may be seated on a top of the piston ring 73*r*. The piston 73 may divide the hydraulic chamber into an opening portion and a closing portion. The lower housing 72 may have an opener port 78*o* and a closer port 78*c* formed through an outer wall of the fork 72*f*, each port in fluid communication with a respective portion of the hydraulic chamber. Supply of hydraulic fluid to the closer port 78*c* may longitudinally move the piston 73 upward to drive the packing element 74 along the bowl 74*b*, thereby constricting the inner seal 74*n* into the AID bore. The inner wall 73*n* of the piston 73 may overlap the inner wall of the fork 72*f* to serve as a guide during stroking of the piston. Supply of hydraulic fluid to the opener port 78*o* may longitudinally move the piston 73 downward to release the packing element 74, thereby relaxing the inner seal 74*n* from the AID bore.

In order to minimize the maximum outer diameter of the AID 70, a pattern including the holes of the lower flange 71*w* and the sockets of the upper flange 72*u* may be radially staggered in an alternating fashion around the respective flanges. The AID pattern may further include an external scallop 79*s* for each junction 76*c,k* formed in the outer wall of the lower housing fork 72*f* and formed in the upper flange 72*u* of the lower housing 72 and a corresponding socket 79*k* formed in the lower flange 71*w* of the upper housing 71. The scallops 79*s* and sockets 79*k* may be symmetrically arranged about the AID 70, such as four spaced at ninety-degrees.

Each junction 76*c,k* may include a respective scallop 79*s* and socket 79*k*, upper 80 and lower 81 fittings, a penetrator 82, a carrier 83, a clamp 84, and upper 85 and lower 86 end couplings. Each end coupling 85, 86 may be formed in or attached to, such as by welding, an adjacent end of the respective jumper 64*u,b*, 65*u,b*. The carrier 83 may be tubular and have a central groove formed in an outer surface thereof. In one embodiment, the carrier 83 may be coupled to the lower housing 72. For example, the carrier 83 may be inserted into the respective scallop 79*s* and then the clamp 84 placed over the carrier groove and received by the scallop 79*s* and fastened to the lower housing 72, thereby connecting the carrier to the lower housing. The carrier 83 may have upper and lower receptacle portions, each carrying one or more (pair shown) seals.

The penetrator 82 may be tubular and have an upper receiver portion and a lower stinger portion. The penetrator receiver portion may have an inner thread, an inner recess, an inner shoulder, and an inner receptacle carrying one or more (pair shown) seals. The penetrator stinger portion may have an outer thread. The penetrator 82 may be connected to the upper housing 71 by screwing the outer thread of the stinger portion into an inner thread of the respective socket 79*k*. The threaded connection between the penetrator 82 and the upper housing 71 may be secured by a snap ring.

In an alternative embodiment, the carrier 83 is inserted into a scallop formed in the upper housing 71 and the carrier 83 is fastened to the upper housing 71 using the clamp 84. In this embodiment, the penetrator 82 is threaded into a socket formed in lower housing 72.

Once all of the carriers 83 have been connected to the lower housing 72 and all of the penetrators 82 have been connected to the upper housing 71, the penetrator stinger portions may be stabbed into the upper receptacles of the carriers as the upper housing lower flange 71*w* is lowered onto the lower housing upper flange 72*u*. Connection of the adjacent housing flanges 71*w*, 72*u* by screwing in the studs 77*s* and nuts 77*n* may also connect the penetrators 82 and carriers 83.

The upper end coupling 85 may have a stinger and an outer shoulder. The upper end coupling shoulder may have a tapered upper face and a straight lower face. A nut 80*n* of the upper fitting 80 may be slid over the upper end coupling 85. A split wedge sleeve 80*s* of the upper fitting 80 may then be expanded and placed onto the tapered upper face of the outer shoulder of the upper end coupling 85 and released to snap into place. The upper end coupling 85 may then be stabbed into the penetrator 82 until the straight lower face of the upper end coupling shoulder seats against the internal shoulder of the penetrator receiver portion, thereby engaging the stinger of the upper end coupling 85 with the seals of the inner receptacle. The nut 80*n* may then be screwed into the inner thread of the penetrator receiver portion, thereby trapping the split wedge sleeve 80*s* between a bottom of the nut and the tapered upper surface of the outer shoulder of the upper end coupling 85 and connecting the upper end coupling 80 to the penetrator 82. Fluid force tending to separate the connection between the upper end coupling 80 and the penetrator 82 may drive the tapered upper surface of the outer shoulder of the upper end coupling 85 along the wedge sleeve 80*s* and expand the wedge sleeve 80*s* into engagement with an inner surface of the penetrator receiver portion, thereby locking the connection.

The lower receiver portion of the carrier 83 may be similar to the penetrator receiver portion and the lower end coupling 86 may be connected to the carrier using a split wedge sleeve 81*s* and nut 81*n* of the lower fitting 81 in a similar fashion to connection of the upper end coupling 80 to the penetrator 82.

In one embodiment, the AID 70 includes a bleed line junction 76*b*. The bleed line connection 76*b* is configured to prevent hydraulic lock by equalizing fluid pressure above and below the packing element 74. In one embodiment, the bleed line connection 76*b* includes a pin connector 202, an adapter 204, a penetrator 206, and the carrier 83, as shown in FIG. 2E.

The penetrator 206 is coupled to the upper housing 71 of the AID 70, such as by a threaded connection. Once the carrier 83 has been connected to the lower housing 72 and the penetrator 206 has been connected to the upper housing 71, a stinger portion of the penetrator 206 is stabbed into an upper receptacle of the carrier 83 as the upper housing lower flange 71*w* is lowered onto the lower housing upper flange 72*u*. Thereafter, the adapter 204 is coupled to the penetrator 206, such as by a threaded connection. Alternatively, the adapter 204 is coupled to the penetrator 206 before the penetrator 206 is coupled to the upper housing 71. The adapter 204 is made up to the penetrator 206 to provide a longitudinal clearance for the pin connector 202 to be coupled to the lower spool 61*b*. After the pin connector 202 is coupled to the lower spool 61*b*, the adapter 204 is backed off from the penetrator 206. For example, the adaptor 204 is unthreaded from the penetrator 206 such that adaptor 204 moves upwards and sealingly engages both the pin connector 202 and the penetrator 206.

In one embodiment, the carrier 83 is coupled to the lower housing 72 of the AID 70 using the clamp 84 as described above. The carrier 83 is also coupled to an auxiliary jumper 210, such as by the lower fittings 81. In one embodiment, the auxiliary jumper 210 routes fluid directly to the diverter 21. In another embodiment, the auxiliary jumper 210 routes fluid to an existing line, which transports returns to the diverter 21. For example, the auxiliary jumper 210 routes fluid to an RCD return line 26 via the shutoff valve 68*r* (see FIGS. 1B and 5A). By routing fluid from the auxiliary jumper 210 to the shutoff valve 68*r*, fewer lines extending to the diverter 21 are required.

FIGS. 5A-5C illustrate the offshore drilling system 1 in an overbalanced drilling mode. Once the riser 25, PCA 1*p*, MPRP 60, and UMRP 20 have been deployed, drilling of the lower formation 54*b* may commence. The running tool 38 may be replaced by a top drive 5 and the fluid handling system 1*h* may be installed. The drill string 10 may be deployed into the wellbore 55 through the UMRP 20, MPRP 60, riser 25, PCA 1*p*, and casing 52.

The drilling rig 1*r* may further include a rail (not shown) extending from the rig floor 4 toward the crown block 8. The top drive 5 may include a motor, an inlet, a gear box, a swivel, a quill, a trolley (not shown), a pipe hoist (not shown), and a backup wrench (not shown). The top drive motor may be electric or hydraulic and have a rotor and stator. The motor may be operable to rotate the rotor relative to the stator which may also torsionally drive the quill via one or more gears (not shown) of the gear box. The quill may have a coupling (not shown), such as splines, formed at an upper end thereof and torsionally connecting the quill to a mating coupling of one of the gears. Housings of the motor, swivel, gear box, and backup wrench may be connected to one another, such as by fastening, so as to form a non-rotating frame. The top drive 5 may further include an interface (not shown) for receiving power and/or control lines.

The trolley may ride along the rail, thereby torsionally restraining the frame while allowing vertical movement of the top drive 5 with the travelling block 6. The traveling block 6 may be connected to the frame via the heave compensator 31 to suspend the top drive from the derrick 3. The swivel may include one or more bearings for longitudinally and rotationally supporting rotation of the quill relative to the frame. The inlet may have a coupling for connection to a mud hose 17*h* and provide fluid communication between the mud hose and a bore of the quill. The quill may have a coupling, such as a threaded pin, formed at a lower end thereof for connection to a mating coupling, such as a threaded box, at a top of the drill string 10.

The drill string 10 may include a bottomhole assembly (BHA) 10*b* and joints of drill pipe 10*p* connected together, such as by threaded couplings. The BHA 10*b* may be connected to the drill pipe 10*p*, such as by a threaded connection, and include a drill bit 12 and one or more drill collars 11 connected thereto, such as by a threaded connection. The drill bit 12 may be rotated 13 by the top drive 5 via the drill pipe 10*p* and/or the BHA 10*b* may further include a drilling motor (not shown) for rotating the drill bit. The BHA 10*b* may further include an instrumentation sub (not shown), such as a measurement while drilling (MWD) and/or a logging while drilling (LWD) sub.

The fluid handling system 1*h* may include a fluid tank 15, a supply line 17*p,h*, one or more shutoff valves 18*a-f*, an RCD return line 26, a diverter return line 29, a mud pump 30, a hydraulic power unit (HPU) 32*h*, a hydraulic manifold 32*m*, a cuttings separator, such as shale shaker 33, a pressure gauge 34, the programmable logic controller (PLC) 35, a return bypass spool 36*r*, a supply bypass spool 36*s*. A first end of the diverter return line 29 may be connected to an outlet of the diverter 21 and a second end of the return line may be connected to the inlet of the shaker 33. A lower end of the RCD return line 26 may be connected to the shutoff valve 68*r* and an upper end of the return line may have shutoff valve 18*c* and be blind flanged. An upper end of the return bypass spool 36*r* may be connected to the shaker inlet and a lower end of the return bypass spool may have shutoff valve 18*b* and be blind flanged. A transfer line 16 may connect an outlet of the fluid tank 15 to the inlet of the mud pump 30. A lower end of the supply line 17*p,h* may be connected to the outlet of the mud pump 30 and an upper end of the supply line may be connected to the top drive inlet. The pressure gauge 34 and supply shutoff valve 18*f* may be assembled as part of the supply line 17*p,h*. A first end of the supply bypass spool 36*s* may be connected to the outlet of the mud pump 30*d* and a second end of the bypass spool may be connected to the standpipe 17*p* and may each be blind flanged. The shutoff valves 18*d,e* may be assembled as part of the supply bypass spool 36*s*.

Additionally, the fluid handling system 1*h* may include a back pressure line (not shown) having a lower end connected to the shutoff valve 68*f* and having an upper end with a shutoff valve 18*c* and blind flange.

In the overbalanced drilling mode, the mud pump 30 may pump the drilling fluid 14*d* from the transfer line 16, through the pump outlet, standpipe 17*p* and Kelly hose 17*h* to the top drive 5. The drilling fluid 14*d* may flow from the Kelly hose 17*h* and into the drill string 10 via the top drive inlet. The drilling fluid 14*d* may flow down through the drill string 10 and exit the drill bit 12, where the fluid may circulate the cuttings away from the bit and carry the cuttings up the annulus 56 formed between an inner surface of the casing 52 or wellbore 55 and the outer surface of the drill string 10. The returns 14*r* may flow through the annulus 56 to the wellhead 50. The returns 14*r* may continue from the wellhead 50 and into the riser 25 via the PCA 1*p*. The returns 14*r* may flow up the riser 25, through the MPRP 60, and to the diverter 21. The returns 14*r* may flow into the diverter return line 29 via the diverter outlet. The returns 14*r* may continue through the diverter return line 29 to the shale shaker 33 and be processed thereby to remove the cuttings, thereby completing a cycle. As the drilling fluid 14*d* and returns 14*r* circulate, the drill string 10 may be rotated 13 by the top drive 5 and lowered by the traveling block, thereby extending the wellbore 55 into the lower formation 54*b*.

The drilling fluid 14*d* may include a base liquid. The base liquid may be base oil, water, brine, or a water/oil emulsion. The base oil may be refined or synthetic. The drilling fluid 14*d* may further include solids dissolved or suspended in the base liquid, such as organophilic clay, lignite, and/or asphalt, thereby forming a mud.

Figures 6A, 6B:
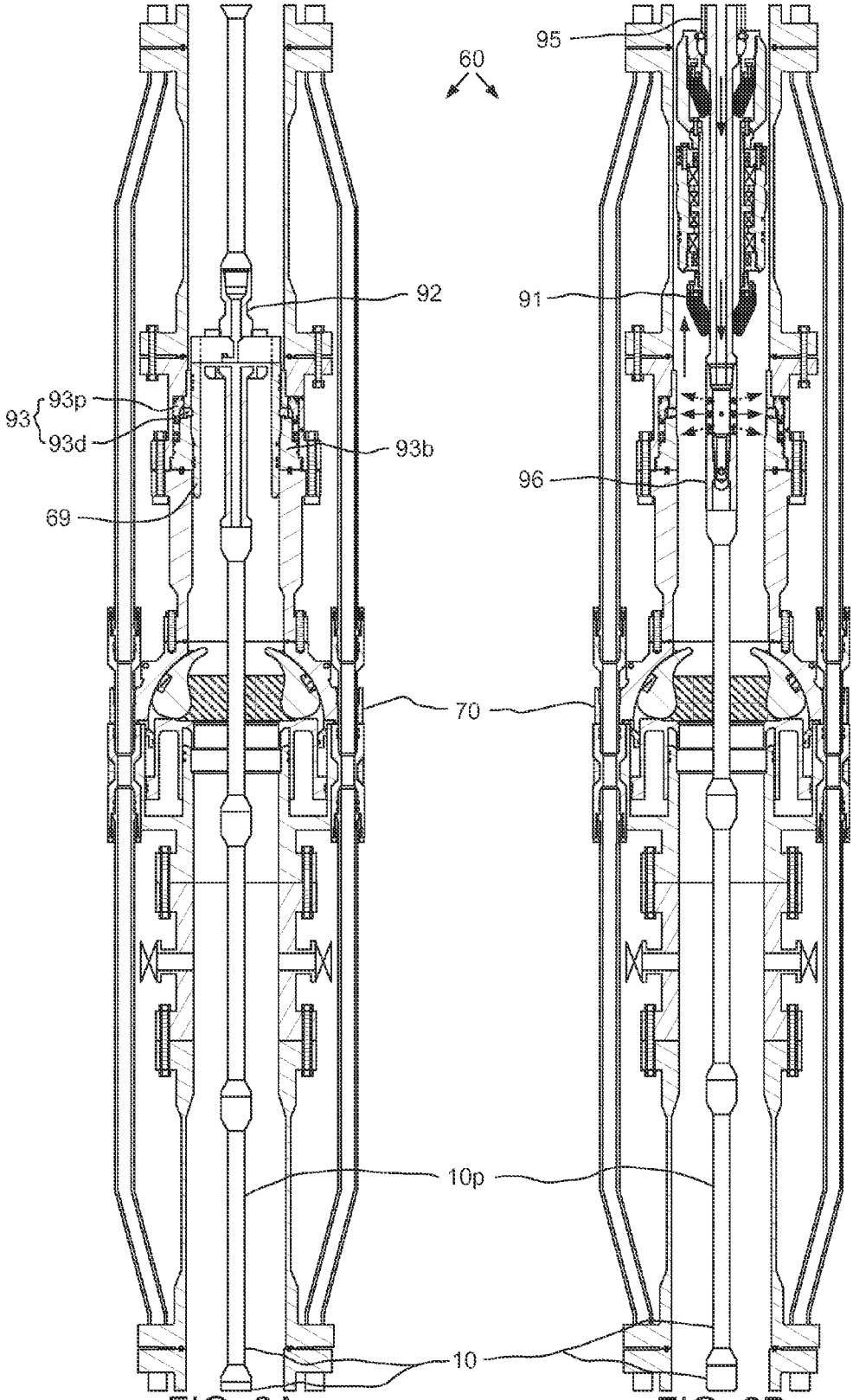
FIGS. 6A-6C illustrate shifting of the drilling system from the overbalanced drilling mode to a managed pressure drilling mode.
Figures 6C, 6D:
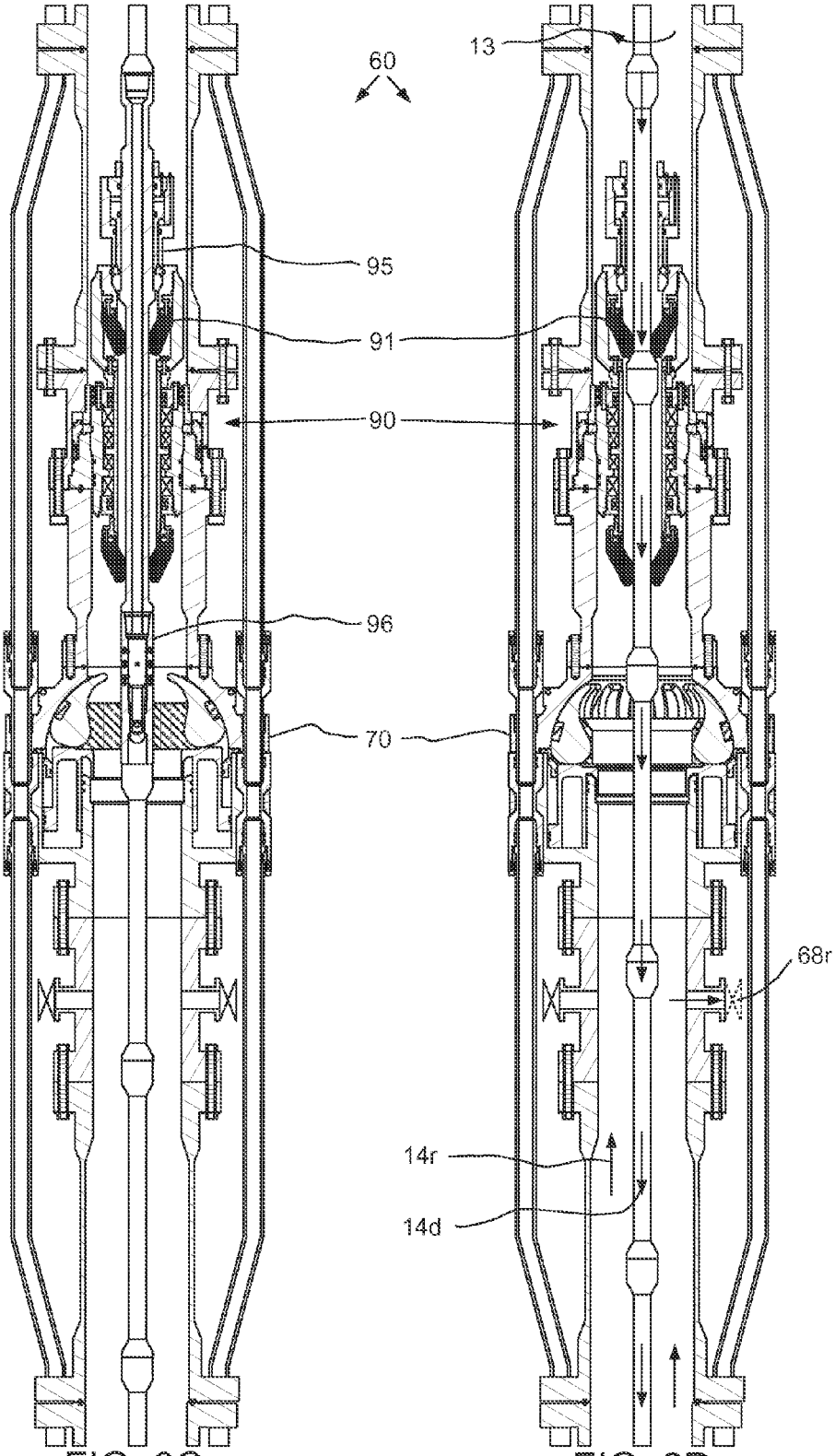
FIG. 6D illustrates the offshore drilling system in the managed pressure drilling mode.

FIGS. 6A-6C illustrate shifting of the drilling system 1 from the overbalanced drilling mode to a managed pressure drilling mode. Should an unstable zone in the lower formation 54*b* be encountered, the drilling system 1 may be shifted into the managed pressure mode.

To shift the drilling system, an RCD 90 may be assembled by retrieving a protector sleeve 69 from the RCD housing 61 and replacing the protector sleeve with a bearing assembly 91. The RCD 90 may include the housing 61, a latch 93, the protector sleeve 69 and the bearing assembly 91. The latch 93 may include a hydraulic actuator, such as a piston 93*p*, one or more (two shown) fasteners, such as dogs 93*d*, and a body 93*b*. The latch body 93*b* may be connected to the housing 61, such as by a threaded connection. A piston chamber may be formed between the latch body 93*b* and RCD housing latch spool 61*m*. The latch body 93*b* may have openings formed through a wall thereof for receiving the respective dogs 93*d*. The latch piston 93*p* may be disposed in the chamber and may carry seals isolating an upper portion of the chamber from a lower portion of the chamber. A cam surface may be formed on an inner surface of the piston 93*p* for radially displacing the dogs 93*d*. The latch body 93*b* may further have a landing shoulder formed in an inner surface thereof for receiving the protective sleeve 69 or the bearing assembly 91.

The bearing assembly 91 may include a bearing pack, a housing seal assembly, one or more strippers, and a catch sleeve. The bearing assembly 91 may be selectively connected to the housing 61 by engagement of the latch 93 with the catch sleeve. The RCD housing latch spool 61*m* may have hydraulic ports in fluid communication with the piston 93*p* and an interface (not shown) of the RCD 90. The bearing pack may support the strippers from the catch sleeve such that the strippers may rotate relative to the RCD housing 61 (and the catch sleeve). The bearing pack may include one or more radial bearings, one or more thrust bearings, and a self contained lubricant system. The bearing pack may be disposed between the strippers and be housed in and connected to the catch sleeve, such as by a threaded connection and/or fasteners.

Each stripper may include a gland or retainer and a seal. Each stripper seal may be directional and oriented to seal against drill pipe 10*p* in response to higher pressure in the riser 25 than the UMRP 20. Each stripper seal may have a conical shape for fluid pressure to act against a respective tapered surface thereof, thereby generating sealing pressure against the drill pipe 10*p*. Each stripper seal may have an inner diameter slightly less than a pipe diameter of the drill pipe 10*p* to form an interference fit therebetween. Each stripper seal may be flexible enough to accommodate and seal against threaded couplings of the drill pipe 10*p* having a larger tool joint diameter. The drill pipe 10*p* may be received through a bore of the bearing assembly so that the strippers may engage the drill pipe. The stripper seals may provide a desired barrier in the riser 25 either when the drill pipe 10*p* is stationary or rotating. Once deployed, the MPRP 60 may be submerged adjacent the waterline 2*s*.

Alternatively, an active seal RCD may be used. Alternatively, the MPRP 60 may be located above the waterline 2*s* and/or as part of the riser 25 at any location therealong or as part of the PCA 1*p*. If assembled as part of the PCA 1*p*, the RCD return line 29 may extend along the riser 25 as one of the auxiliary lines.

The RCD interface may be in fluid communication with the HPU 32*h* and in communication with the PLC 35 via an RCD umbilical 19. The RCD umbilical 19 may have hydraulic conduits for operation of the RCD latch 93, the AID piston 73, and actuators of the shutoff valves 68*f,r*. Hydraulic conduits (not shown) may extend from the RCD interface to the components of the MPRP 60.

To retrieve the protective sleeve 69, drilling may be halted by stopping advancement and rotation 13 of the top drive 5, removing weight from the drill bit 12, and halting circulation of the drilling fluid 14*d*. The AID 70 may then be closed against the drill string 10. The drawworks 9 may be operated to raise the top drive 5 and drill string 10 until a top stand of the drill string 10 is above the rig floor 4, thereby also pulling the drill bit 12 from a bottom of the wellbore 55. A spider may then be operated to engage the drill string 10, thereby longitudinally supporting the drill string 10 from the rig floor 4. The top stand may be unscrewed from the drill string 10 and the quill and hoisted to the pipe rack. The process may then be repeated until enough stands (i.e., one to five stands) have been removed from the drill string 10 to deploy a protective sleeve running tool (PSRT) 92 using the remaining drill string 10. The drill bit 12 may remain in the wellbore 55 during deployment of the PSRT 92.

The PSRT 92 may be preassembled with one or more joints of drill pipe 10*p* to form a stand. The PSRT stand may be hoisted from the pipe rack and connected to the drill string 10 and the quill. The spider may then be operated to release the drill string 10. The top drive 5 and the drill string 10 (with assembled PSRT stand) may be lowered until a top coupling of the PSRT stand is adjacent the rig floor 4. One or more additional stands may be added to the drill string 10 until the PSRT 92 arrives at the RCD housing 61. Lugs of the PSRT 92 may be engaged with J-slots of the protective sleeve 69, the PSRT lowered to move the lugs along the J-slots, rotated across the J-slots by the top drive 5, and then raised to seat the lugs at a closed end of the J-slots. The latch piston 93*p* may then be operated by supplying hydraulic fluid from the HPU 32*h* and manifold 32*m* to a latch chamber of the RCD housing 61 via the RCD umbilical 19, thereby moving the piston 93*p* clear from the dogs 93*d* so that the dogs may be pushed radially outward by removal of the protective sleeve 69. The drill string 10 may then be raised by removing stands until the PSRT 92 and latched protective sleeve 69 reach the rig floor 4. The PSRT 92 and protective sleeve 69 may then be disassembled from the drill string 10.

A bearing assembly running tool (BART) 95 and jetting tool 96 may be stabbed into the bearing assembly 91 to form a running assembly. The running assembly may then be assembled as part of the drill string 10 in a similar fashion as discussed above for the PSRT stand. Once the running assembly 97 has been added to the drill string 10, the spider may then be operated to release the drill string. The top drive 5 and the drill string 10 may be lowered until a top coupling of the BART 95 is adjacent the rig floor 4. A control line (not shown) may be connected to the BART 95 and one or more additional stands may be added to the drill string 10 until the jetting tool 96 arrives at the latch 93. A wash pump (not shown) may then be operated to inject wash fluid down the drill string 10 to the jetting tool 96. The jetting tool 96 may discharge the wash fluid into the latch 93 to flush any debris therefrom which may otherwise obstruct landing of the bearing assembly 91.

Once the latch 93 has been washed, the drill string 10 may be further lowered until the landing shoulder of the catch sleeve seats onto a landing shoulder of the RCD housing 61. The latch piston 93*p* may then be operated by supplying hydraulic fluid from the HPU 32*h* and manifold 32*m* to the latch chamber via the RCD umbilical 19, thereby radially moving the latch dogs inward to engage the catch profile of the catch sleeve.

A latch piston of the BART 95 may then be operated by supplying compressed air to a latch chamber of the BART via the control line, thereby moving a piston of the BART clear from latch dogs thereof so that the BART latch dogs may be pushed radially outward by removal of the BART. Once the bearing assembly 91 has been latched to the RCD housing 61, the AID 70 may be opened and the drill string 10 may be raised by removing stands until the BART 95 and jetting tool 96 reach the rig floor 4. The BART 95 and jetting tool 96 may then be disassembled from the drill string 10.

Also as part of the shift of the drilling system 1, a managed pressure return spool (not shown) may be connected to the RCD return line 26 and the bypass return spool 36*r*. The managed pressure return spool may include a returns pressure sensor, a returns choke, a returns flow meter, and a gas detector. A managed pressure supply spool (not shown) may be connected to the supply bypass spool 36*s*. The managed pressure supply spool may include a supply pressure sensor and a supply flow meter. Each pressure sensor may be in data communication with the PLC 35. The returns pressure sensor may be operable to measure backpressure exerted by the returns choke. The supply pressure sensor may be operable to measure standpipe pressure.

The returns flow meter may be a mass flow meter, such as a Coriolis flow meter, and may be in data communication with the PLC 35. The returns flow meter may be connected in the spool downstream of the returns choke and may be operable to measure a flow rate of the returns 14*r*. The supply flow meter may be a volumetric flow meter, such as a Venturi flow meter. The supply flow meter may be operable to measure a flow rate of drilling fluid 14*d* supplied by the mud pump 30 to the drill string 10 via the top drive 5. The PLC 35 may receive a density measurement of the drilling fluid 14*d* from a mud blender (not shown) to determine a mass flow rate of the drilling fluid. The gas detector may include a probe having a membrane for sampling gas from the returns 14*r*, a gas chromatograph, and a carrier system for delivering the gas sample to the chromatograph.

Once the managed pressure return spool has been installed, the shutoff valves 18*c* and 68*r* may be opened.

Additionally, a degassing spool (not shown) may be connected to a second return bypass spool (not shown). The degassing spool may include automated shutoff valves at each end and a mud-gas separator (MGS). A first end of the degassing spool may be connected to the return spool between the gas detector and the shaker 33 and a second end of the degasser spool may be connected to an inlet of the shaker. The MGS may include an inlet and a liquid outlet assembled as part of the degassing spool and a gas outlet connected to a flare or a gas storage vessel. The PLC 35 may utilize the flow meters to perform a mass balance between the drilling fluid and returns flow rates and activate the degassing spool in response to detecting a kick of formation fluid.

Alternatively, the managed pressure supply and return spools may be installed before closing of the AID 70 and the backpressure line connected to a backpressure pump (not shown). A flow meter may be assembled as part of the backpressure line and may be placed in communication with the PLC 35. The AID 70 may then be closed, the shutoff valves 68*f,r* may be opened, and the backpressure pump operated to circulate drilling fluid 14*d* through the flow spool 62 during retrieval of the protective sleeve 69 and installation of the bearing assembly 91. The PLC 35 may operate the returns choke to exert back pressure on the annulus 56 to mimic an equivalent circulation density of the returns 14*r* and perform the mass balance to monitor control over the lower formation 54*b*.

FIG. 6D illustrates the offshore drilling system 1 in the managed pressure drilling mode. The RCD 90 may divert the returns 14*r* into the RCD return line 26 via the open shutoff valve 68*r* and through the managed pressure return spool to the shaker 33. During drilling, the PLC 35 may perform the mass balance and adjust the returns choke accordingly, such as tightening the choke in response to a kick and loosening the choke in response to loss of the returns. As part of the shift to managed pressure mode, a density of the drilling fluid 14*d* may be reduced to correspond to a pore pressure gradient of the lower formation 54*b*.

The RCD 90 may further include a one or more sensors (not shown) to monitor health of the bearing assembly 91, such as a pressure sensor in fluid communication with a chamber formed between the strippers. Should health of the bearing assembly 91 deteriorate, such as by detecting failure of the lower stripper, drilling may be halted and the AID 70 closed to facilitate replacement of the bearing assembly. The exhausted bearing assembly may be retrieved by reversing the steps of installation of the bearing assembly, discussed above, and a replacement bearing assembly (not shown) installed by repeating the steps of installation of the bearing assembly 91, discussed above.

Should the AID packing element 74 require replacement, the top drive 5 may be replaced by the running tool 38 and the running tool operated to engage the diverter mandrel. The UMRP 20, MPRP 60, riser 25, and LMRP may then be disconnected from the rest of the PCA 1*p* by operating the connector 40*u*. The riser packages 20, 60 and riser 25 may be lifted and disassembled until the AID 70 reaches the rig floor 4 and the lower housing 72 is supported by the riser spider. For example, the riser spider engages a downward-facing shoulder formed in the lower housing 72. The upper housing 71 may disconnected and removed from the lower housing 72 and the packing element replaced. The process may be reversed to reinstall the riser packages 20, 60 and riser 25.

Figure 7A:
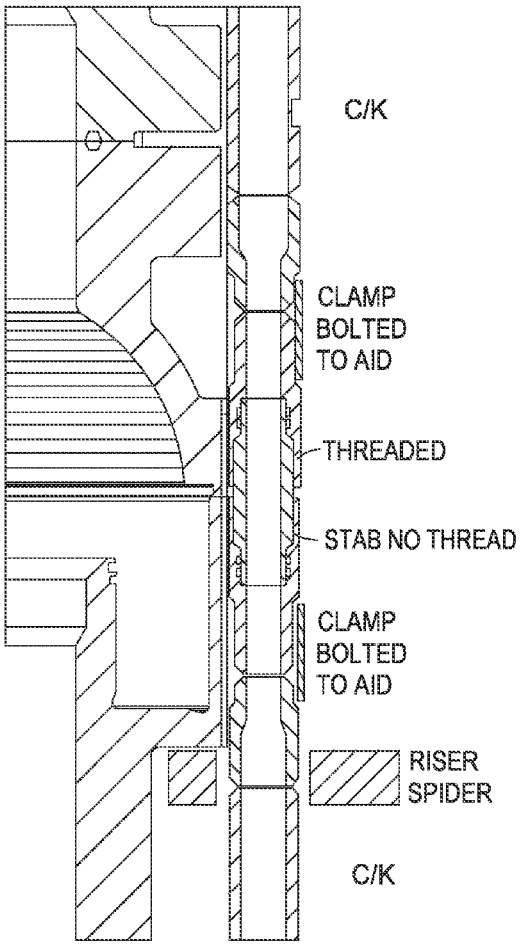
FIGS. 7A and 7B illustrate a first alternative riser auxiliary line junction for the AID, according to another embodiment of the present disclosure.
Figure 7B:
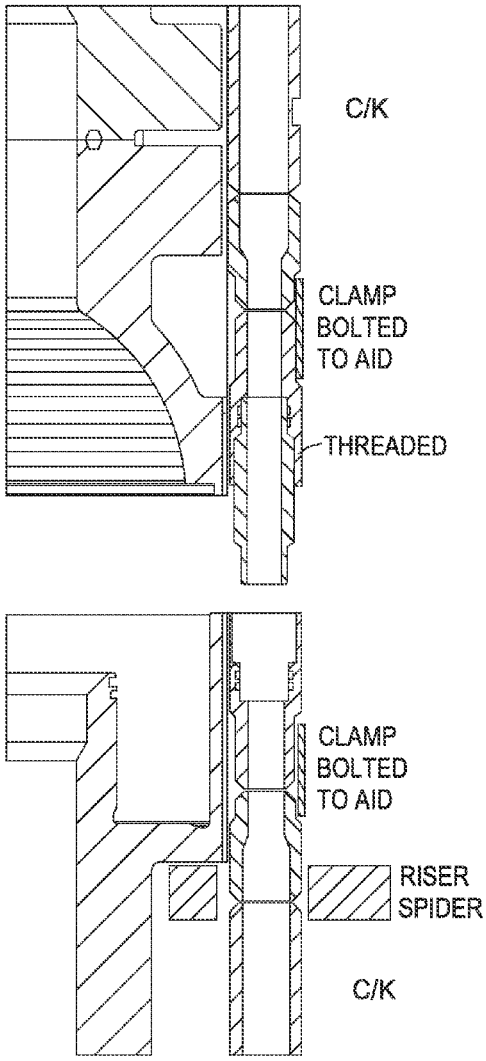

FIGS. 7A and 7B illustrate a first alternative riser auxiliary line junction for the AID, according to another embodiment of the present disclosure. The first alternative riser auxiliary line junction may include a scallop formed in each housing, upper and lower end couplings, upper and lower clamps, and a bridge sleeve. Each end coupling may be formed in or attached to, such as by welding, an adjacent end of the respective jumper 64*u,b*, 65*u,b* and clamped to a respective housing by a respective clamp. Each end coupling may have an inner receptacle carrying one or more seals for engaging a respective end of the bridge sleeve. One of the end couplings may have an inner thread and the bridge sleeve may have an outer thread for connection to the threaded one of the end couplings and a stinger for stabbing into the other end coupling.

Figure 8C:
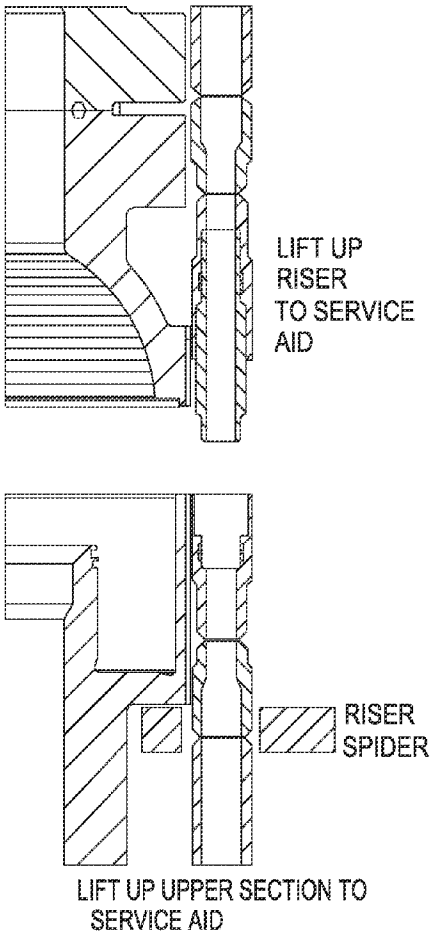
FIGS. 8A-8C illustrate a second alternative riser auxiliary line junction for the AID, according to another embodiment of the present disclosure.
Figure 8B:
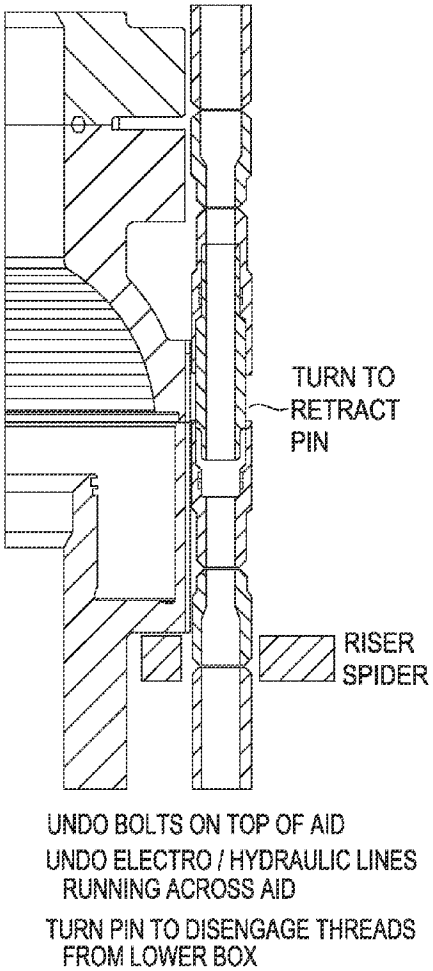
Figure 8A:
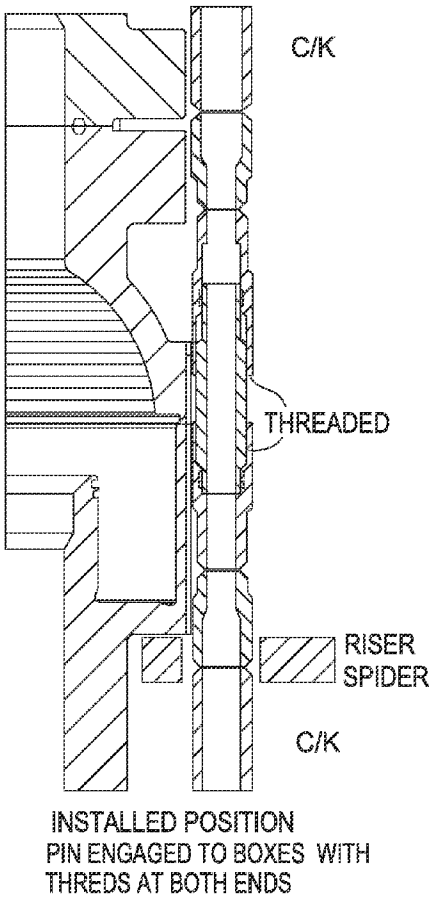

FIGS. 8A-8C illustrate a second alternative riser auxiliary line junction for the AID, according to another embodiment of the present disclosure. The second alternative riser auxiliary line junction may include a scallop formed in each housing, upper and lower end couplings, upper and lower clamps, and a pin. Each end coupling may be formed in or attached to, such as by welding, an adjacent end of the respective jumper 64*u,b*, 65*u,b* and clamped to a respective housing by a respective clamp. Each end coupling may have an inner receptacle carrying one or more seals for engaging a respective end of the pin. Each of the end couplings may also have a threaded box formed at an opposing end thereof and the pin may have first and second outer threads for connection to the respective end couplings. One of the end couplings may have a longer receptacle and threaded box than the other to permit retraction of the pin from the other end coupling.

Figure 9A:
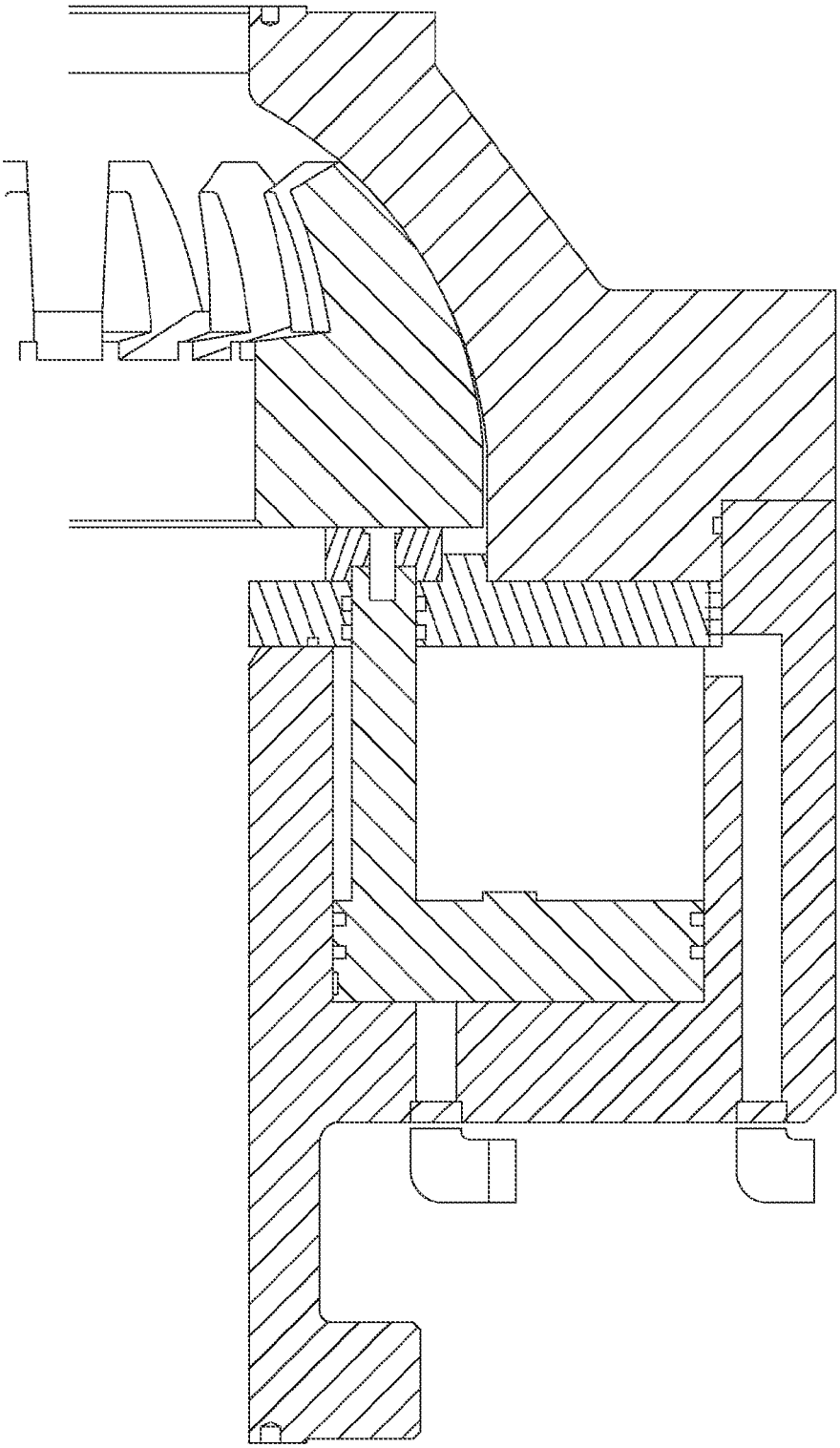
FIGS. 9A and 9B illustrate an alternative AID, according to another embodiment of the present disclosure.
Figure 9B:
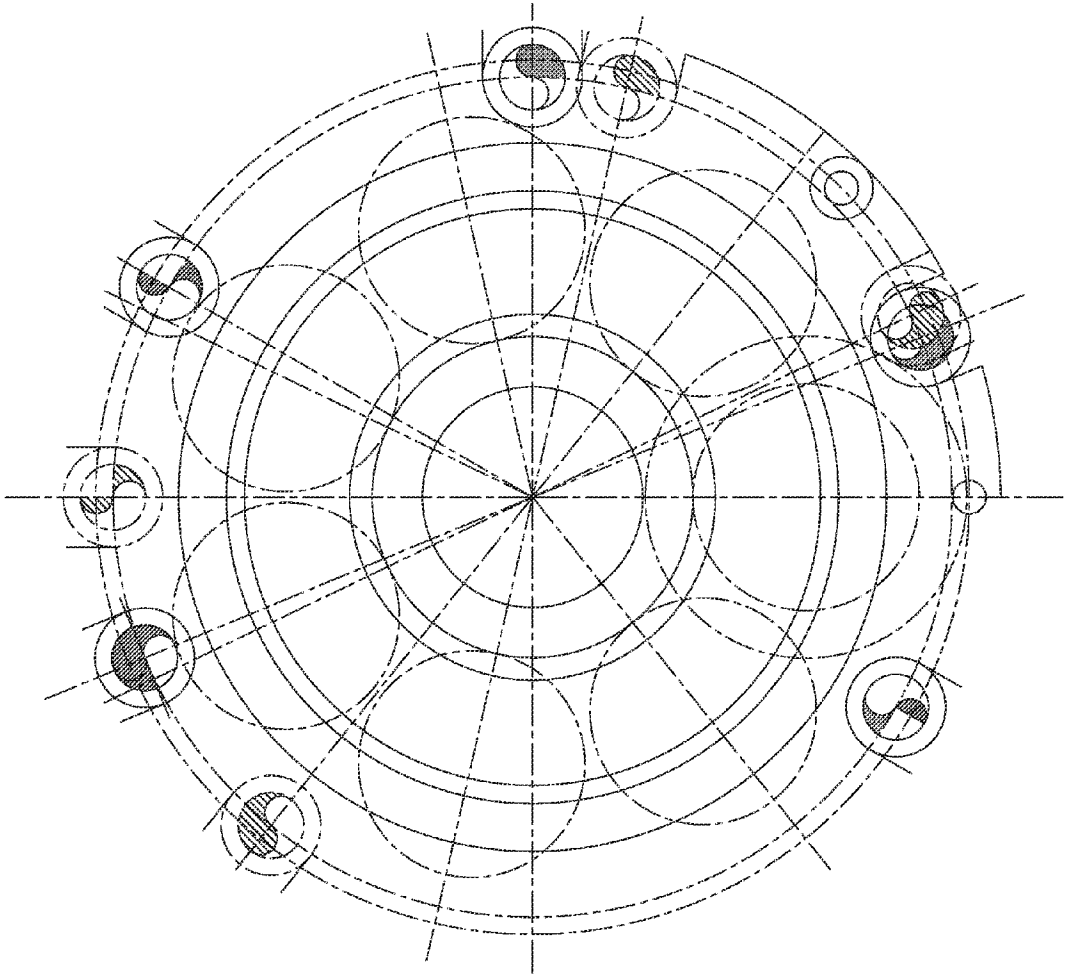

FIGS. 9A and 9B illustrate an alternative AID, according to another embodiment of the present disclosure. The alternative AID may be an annular BOP, such as a spherical BOP, and may include an upper housing, a lower housing, a plurality of pistons, the packing element 74, an adapter disk, a guide ring, and one or more riser auxiliary line junctions.

The upper housing may have an upper flange, a lower flange, and a bowl connecting the flanges. The bowl and flanges may be integrally formed or welded together. The lower housing may have a lower flange, an inner wall extending from the lower flange, and plurality of chamber walls, each chamber wall extending from an outer surface of the inner wall. The chamber walls may be spaced around the lower housing and spaces may be formed between adjacent walls. Each chamber wall, an outer surface of the inner wall, and the adapter disk may form a hydraulic chamber.

The lower flange of the upper housing may have an outer groove formed in a lower face thereof and a periphery of each chamber wall may extend into the groove. The lower flange of the upper housing and each chamber wall of the lower housing may be connected by a plurality of threaded fasteners, such as studs and nuts. Disconnection of the upper housing from the lower housing may facilitate replacement of the packing element 74.

Each chamber wall may have a shoulder formed in an inner surface thereof and an outer edge of the adapter disk may extend into the shoulders, thereby trapping the adapter disk between the upper and lower housings. A boss may be formed in an upper surface of the adapter disk and may divide the adapter disk into an inner portion and an outer portion. A lower portion of the upper housing section may be disposed adjacent to the outer portion of the upper surface of the adapter disk and an inner surface of the upper housing may be disposed adjacent to the boss, thereby laterally trapping the adapter disk by an inner surface of the upper housing. The adapter disk may have a plurality of seal bores formed through the inner portion thereof and a rod of each piston may extend through the respective seal bore. An inner edge of each adapter disk may cover a top of the inner wall of the lower housing. The adapter disk may carry seals for sealing interfaces between the adapter disk and the inner wall of the lower housing, the adapter disk and an inner surface of each chamber wall, and the adapter disk and each piston rod. The upper housing may carry a seal for sealing an interface between the upper and lower housings.

Each piston may have a disk and a rod extending from an upper surface of the respective disk. Each piston disk may be disposed in the respective hydraulic chamber and may carry one or more (pair shown) seals engaged with an inner surface of the respective chamber wall and an outer surface of the inner wall of the lower housing. The guide ring may have a groove formed in a bottom thereof and a top of the piston rods may extend into the groove and be connected to the guide ring, such as by threaded fasteners. A bottom of the packing element 74 may be seated on a top of the guide ring. Each piston may divide the respective hydraulic chamber into an opening portion and a closing portion. Each chamber wall may have an opener port and a closer port formed therethrough, each port in fluid communication with a respective portion of the hydraulic chamber. Supply of hydraulic fluid to the closer ports may longitudinally move the pistons upward to drive the packing element 74 along the bowl, thereby constricting the inner seal into the AID bore. Supply of hydraulic fluid to the opener ports may longitudinally move the pistons downward to release the packing element 74, thereby relaxing the inner seal from the AID bore.

In order to minimize the maximum outer diameter of the alternative AID, a junction may be disposed at one or more of the spaces formed between the chamber walls of the lower housing, such as the junctions 76*c,k*, the first alternative riser auxiliary line junctions, or the second alternative riser auxiliary line junctions.

While the foregoing is directed to embodiments of the present disclosure, other and further embodiments of the disclosure may be devised without departing from the basic scope thereof, and the scope thereof is determined by the claims that follow.

In one embodiment, an annular isolation device for managed pressure drilling includes a first housing portion coupled to a second housing portion; a packing element at least partially disposed in the first housing portion; a penetrator coupled to the first housing portion; and a carrier coupled to the second housing portion, wherein the carrier is configured to receive a portion of the penetrator.

In one or more of the embodiments described herein, the first housing portion is an upper housing and the second housing portion is a lower housing.

In one or more of the embodiments described herein, the first housing portion is removable from the second housing portion and the penetrator is removable from the carrier.

In one or more of the embodiments described herein, the penetrator is removable from the carrier when the first housing portion is removable from the second housing portion.

In one or more of the embodiments described herein, the penetrator extends into a portion of the carrier.

In one or more of the embodiments described herein, the first housing portion is coupled to the penetrator while the second housing portion is coupled to the carrier.

In one or more of the embodiments described herein, the penetrator is fastened to the first housing portion and the carrier is fastened to the second housing portion.

In one or more of the embodiments described herein, the penetrator is coupled to a fluid communication line using a threaded nut and a wedge sleeve.

In one or more of the embodiments described herein, the fluid communication line includes an enlarged diameter portion having a flat lower shoulder and a sloped upper shoulder, wherein the wedge sleeve engages the sloped upper shoulder, and wherein the flat lower shoulder engages a corresponding shoulder formed on an inner surface of the penetrator.

In one or more of the embodiments described herein, the device also includes a piston configured to actuate the packing element.

In one or more of the embodiments described herein, the device also includes a plurality of pistons configured to actuate the packing element.

In one or more of the embodiments described herein, the penetrator and the carrier are configured to provide fluid communication between a first fluid communication line and a second fluid communication line.

In another embodiment, a method of disassembling an annular isolation device (AID) for managed pressure drilling includes landing the AID in a spider, wherein the AID includes: a first housing portion coupled to a second housing portion, a penetrator coupled to the first housing portion, wherein the penetrator is coupled to a first fluid communication line, and a carrier coupled to the second housing portion, wherein the carrier is coupled to a second fluid communication line; and separating the first housing portion and the second housing portion, thereby separating the penetrator and the carrier.

In one or more of the embodiments described herein, the method also includes coupling the first housing portion and the second housing portion; and guiding the penetrator into the carrier.

In one or more of the embodiments described herein, the method also includes removing an annular packing element from the AID.

In one or more of the embodiments described herein, the method also includes separating the penetrator and the first fluid communication line by unthreading a nut disposed around the first fluid communication line and removing a wedge sleeve disposed between penetrator the first fluid communication line.

In one or more of the embodiments described herein, the AID further includes a bleed line junction comprising: a pin connection coupled to the upper housing portion; a bleed line penetrator coupled to the upper housing portion; and an adapter disposed between the pin connector and the bleed line penetrator and movable therebetween, wherein the adaptor sealingly engages both the pin connector and the bleed line penetrator.

In one or more of the embodiments described herein, the method further includes moving the adapter towards the bleed line penetrator, thereby removing the adapter from the pin connector; removing the pin connector from the AID; and removing the adapter from the AID.

In another embodiment, a riser assembly for managed pressure drilling includes an annular isolation device (AID), wherein the AID includes: a first housing portion coupled to a second housing portion, a penetrator coupled to the first housing portion, and a carrier coupled to the second housing portion, wherein the carrier is configured to receive a portion of the penetrator; a first fluid communication line having a first end coupled to the penetrator; and a second fluid communication line having a first end coupled to the carrier, wherein the penetrator and the carrier are configured to provide fluid communication between the first fluid communication line and the second fluid communication line.

In one or more of the embodiments described herein, the assembly also includes a rotating control device coupled to the AID.

In one or more of the embodiments described herein, the first fluid communication line includes a second end coupled to an upper flange and the second fluid communication line includes a second end coupled to a lower flange.

In one or more of the embodiments described herein, the first housing portion is removable from the second housing portion and the penetrator is removable from the carrier.

In one or more of the embodiments described herein, the AID includes a packing element configured to block fluid flow in a bore of the AID.

The invention claimed is:

1. An annular isolation device for managed pressure drilling, comprising:

a first housing portion having a bowl;

a second housing portion;

a packing element at least partially disposed in the bowl of the first housing portion;

a penetrator coupled to the first housing portion; and a carrier coupled to the second housing portion, wherein coupling the first housing portion to the second housing portion stabs the penetrator into the carrier, and separating the first housing portion from the second housing portion separates the penetrator and the carrier, and the penetrator and the carrier are configured to provide fluid communication between a first fluid communication line and a second fluid communication line.

2. The device of claim 1, wherein the first housing portion is removable from the second housing portion and the penetrator is removable from the carrier.

3. The device of claim 1, wherein the penetrator is coupled to the first fluid communication line using a threaded nut and a wedge sleeve.

4. The device of claim 1, further including a piston configured to actuate the packing element.

5. The device of claim 1, further including a plurality of pistons configured to actuate the packing element.

6. An annular isolation device for managed pressure drilling, comprising:

a first housing portion;

a second housing portion;

a packing element at least partially disposed in the first housing portion;

a penetrator coupled to the first housing portion; and a carrier coupled to the second housing portion, wherein coupling the first housing portion to the second housing portion stabs the penetrator into the carrier, and separating the first housing portion from the second housing portion separates the penetrator and the carrier, wherein the first housing portion is an upper housing and the second housing portion is a lower housing.

7. The device of claim 6, wherein the first housing portion has a plurality of sockets forming through a flange of the first housing portion, and the penetrator is coupled to the first housing portion through one of the plurality of sockets.

8. The device of claim 7, wherein the plurality of sockets are radially staggered in an alternating fashion along the flange.

9. An annular isolation device for managed pressure drilling, comprising:

a first housing portion coupled to a second housing portion;

a packing element at least partially disposed in the first housing portion;

a penetrator coupled to the first housing portion, wherein the penetrator is coupled to a fluid communication line using a threaded nut and a wedge sleeve; and a carrier coupled to the second housing portion, wherein the carrier is configured to receive a portion of the penetrator, the fluid communication line includes an enlarged diameter portion having a flat lower shoulder and a sloped upper shoulder, the wedge sleeve engages the sloped upper shoulder, and the flat lower shoulder engages a corresponding shoulder formed on an inner surface of the penetrator.

10. A method of disassembling an annular isolation device (AID) for managed pressure drilling, comprising:

landing the AID in a spider, wherein the AID includes:

a first housing portion coupled to a second housing portion, a penetrator coupled to the first housing portion, wherein the penetrator is coupled to a first fluid communication line, and a carrier coupled to the second housing portion, wherein the carrier is coupled to a second fluid communication line, and the penetrator and the carrier are configured to provide fluid communication between the first fluid communication line and the second fluid communication line;

separating the first housing portion and the second housing portion, thereby separating the penetrator and the carrier; and removing an annular packing element from the AID.

11. The method of claim 10, further comprising:

coupling the first housing portion and the second housing portion; and guiding the penetrator into the carrier.

12. The method of claim 10, further comprising separating the penetrator and the first fluid communication line by unthreading a nut disposed around the first fluid communication line and removing a wedge sleeve disposed between the penetrator and the first fluid communication line.

13. The method of claim 10, wherein the AID further includes a bleed line junction comprising:

a pin connection coupled to the upper housing portion;

a bleed line penetrator coupled to the upper housing portion; and an adapter disposed between the pin connector and the bleed line penetrator and movable therebetween, wherein the adaptor sealingly engages both the pin connector and the bleed line penetrator.

14. The method of claim 13, further comprising:

moving the adapter towards the bleed line penetrator, thereby removing the adapter from the pin connector;

removing the pin connector from the AID; and removing the adapter from the AID.

15. A riser assembly for managed pressure drilling, comprising:

an annular isolation device (AID), wherein the AID includes:

a first housing portion coupled to a second housing portion, a penetrator coupled to the first housing portion, and a carrier coupled to the second housing portion, wherein coupling the first housing portion to the second housing portion stabs the penetrator into the carrier, and separating the first housing portion from the second housing portion separates the penetrator and the carrier;

a rotating control device coupled to the AID;

a first fluid communication line having a first end coupled to the penetrator; and a second fluid communication line having a first end coupled to the carrier, wherein the penetrator and the carrier are configured to provide fluid communication between the first fluid communication line and the second fluid communication line.

16. The assembly of claim 15, wherein the first fluid communication line includes a second end coupled to an upper flange and the second fluid communication line includes a second end coupled to a lower flange.

17. The assembly of claim 15, wherein the first housing portion is removable from the second housing portion and the penetrator is removable from the carrier.

18. The assembly of claim 15, wherein the AID includes a packing element configured to block fluid flow in a bore of the AID.

19. An annular isolation device for managed pressure drilling, comprising:

a first housing portion having a bowl;

a second housing portion;

a packing element at least partially disposed in the bowl of the first housing portion;

a penetrator coupled to the first housing portion; and a carrier coupled to the second housing portion, wherein coupling the first housing portion to the second housing portion stabs the penetrator into the carrier, separating the first housing portion from the second housing portion separates the penetrator and the carrier, and the first housing portion has a plurality of sockets forming through a first flange of the first housing portion, and the penetrator is coupled to the first housing portion through one of the plurality of sockets.

20. The device of claim 19, wherein the plurality of sockets are radially staggered in an alternating fashion along the first flange.

21. The device of claim 19, wherein the second housing portion has a plurality of holes and one or more scallops forming on a second flange, and the plurality of holes and the scallops correspond to the plurality of sockets of the first housing portion.

22. The device of claim 21, wherein the carrier is coupled to the second housing portion through one of the scallops.

* * * * *